US011524218B2

(12) United States Patent
Barr et al.

(10) Patent No.: US 11,524,218 B2
(45) Date of Patent: Dec. 13, 2022

(54) ADJUSTABLE DIFFICULTY ROCK HOLD

(71) Applicant: KidKraft, Inc., Dallas, TX (US)

(72) Inventors: David Barr, Dallas, TX (US); Frederick M. Rieber, Dallas, TX (US)

(73) Assignee: KidKraft, Inc., Dallas, TX (US)

( * ) Notice: Subject to any disclaimer, the term of this patent is extended or adjusted under 35 U.S.C. 154(b) by 55 days.

(21) Appl. No.: 17/257,392

(22) PCT Filed: Jul. 3, 2019

(86) PCT No.: PCT/US2019/040630

§ 371 (c)(1),
(2) Date: Dec. 31, 2020

(87) PCT Pub. No.: WO2020/010268

PCT Pub. Date: Jan. 9, 2020

(65) Prior Publication Data

US 2021/0178240 A1 Jun. 17, 2021

Related U.S. Application Data

(60) Provisional application No. 62/694,433, filed on Jul. 5, 2018.

(51) Int. Cl.
*A63B 69/00* (2006.01)

(52) U.S. Cl.
CPC ..... *A63B 69/0048* (2013.01); *A63B 2208/12* (2013.01); *A63B 2225/09* (2013.01)

(58) Field of Classification Search
CPC ..... A63B 69/0048; A63B 2208/12; A63B 2225/09; A63B 2009/006
See application file for complete search history.

(56) References Cited

U.S. PATENT DOCUMENTS

| | | | | |
|---|---|---|---|---|
| 2007/0240281 | A1 | 10/2007 | Meissner | |
| 2008/0127684 | A1 | 6/2008 | Rudduck et al. | |
| 2018/0304135 | A1* | 10/2018 | Alon | A63B 69/0048 |

FOREIGN PATENT DOCUMENTS

| | | | | |
|---|---|---|---|---|
| EP | 2865426 | A1 * | 4/2015 | F16B 21/04 |
| JP | 2015084873 | A | 5/2015 | |
| JP | 2018000896 | A | 1/2018 | |
| KR | 200443410 | Y1 | 2/2009 | |

(Continued)

OTHER PUBLICATIONS

The International Search Report and the Written Opinion of the International Searching Authority—The Korean Intellectual Property Office—dated Oct. 25, 2019, for International Application No. PCT/US19/40630, 11 pages.

(Continued)

*Primary Examiner* — Jennifer Robertson
(74) *Attorney, Agent, or Firm* — Jackson Walker LLP

(57) ABSTRACT

An adjustable rock hold having a rotatable outer portion configured to rotate about an axis of the adjustable rock hold and rotate with respect to a climbing surface, wherein the adjustable rock hold is configured to be attached to the climbing surface; a plurality of gripping surfaces positioned around an outer edge of the rotatable outer portion; and one or more securing elements configured to secure the rotatable outer portion with respect to the climbing surface.

15 Claims, 23 Drawing Sheets

(56) References Cited

FOREIGN PATENT DOCUMENTS

| | | | | | |
|---|---|---|---|---|---|
| KR | 20090001280 U | * | 2/2009 | ..... | A63B 69/0048 |
| WO | WO-2013160607 A1 | * | 10/2013 | ..... | A63B 69/0048 |

OTHER PUBLICATIONS

The International Preliminary Report on Patentability dated Jan. 14, 2021 by the International Searching Authority—The Korean Intellectual Property Office—for International Application No. PCT/US19/40630, 9 pages.

* cited by examiner

ADJUSTABLE DIFFICULTY ROCK HOLD

CROSS-REFERENCE TO RELATED APPLICATIONS

The present application claims priority to U.S. Provisional Patent Application Ser. No. 62/694,433 filed Jul. 5, 2018 by David Barr, et al. and entitled "Adjustable Difficulty Rock Hold" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Typical children's play structures (including play surfaces, climbing surfaces, and/or climbing structures) may be sold to consumers at least partially disassembled and contained within a box or packaging. The play structures may then be assembled by the user, using the parts and instructions associated with the play structure. A typical climbing surface play structure may be approximately vertical and may comprise one or more protruding elements configured to be attached to the climbing surface to allow a user to climb up or down the climbing surface.

SUMMARY

In some embodiments is an adjustable rock hold comprising a rotatable outer portion that may be configured to rotate about an axis of the adjustable rock hold and rotate with respect to a climbing surface. The adjustable rock hold may be configured to be attached to the climbing surface. The adjustable rock hold may also comprise a plurality of gripping surfaces positioned around an outer edge of the rotatable outer portion. The adjustable rock hold may also comprise one or more securing elements configured to secure the rotatable outer portion with respect to the climbing surface.

In some embodiments is a method of using an adjustable rock hold comprising securing at least a portion of the adjustable rock hold to a play surface. The adjustable rock hold may be positioned in a first configuration. The method may also comprise loosening the attachment between the play surface and the adjustable rock hold. The method may also comprise rotating a rotatable outer portion of the adjustable rock hold with respect to the play surface from the first configuration to a second configuration. The method may also comprise tightening the attachment between the play surface and the adjustable rock hold to maintain the rotatable outer portion in the second configuration.

In some embodiments is play structure comprising a play surface and one or more adjustable rock holds that may be configured to be adjustably attached to the play surface. The one or more adjustable rock holds may comprise a rotatable outer portion that may be configured to rotate about an axis of the adjustable rock hold and rotate with respect to the play surface. The one or more adjustable rock holds may also comprise a plurality of gripping surfaces positioned around an outer edge of the rotatable outer portion. The one or more adjustable rock holds may comprise one or more securing elements configured to secure the rotatable outer portion with respect to the play surface.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
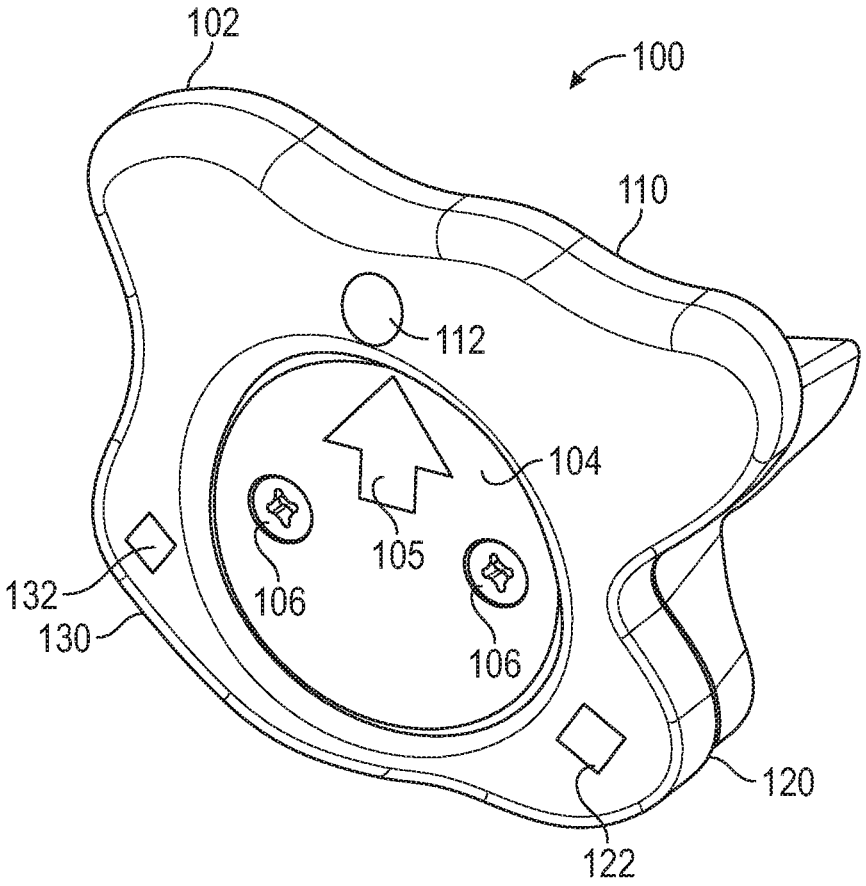
FIG. 1 illustrates a perspective view of an adjustable rock hold according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field (for example, ±10%); and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems, apparatuses, and methods relating to adjustable rock holds for use with a climbing surface, wherein the adjustable rock holds may comprise a plurality of gripping surfaces, and may be rotated to access the plurality of gripping surfaces. The plurality of gripping surfaces may comprise a variation in difficulty or challenge, wherein the grip level can be adjusted for varying levels of difficulty. In some embodiments, an adjustable rock hold may comprise at least two positions for levels of difficulty can be adjusted after installation. A user may also be able to adjust the adjustable rock hold to increase or decrease grip difficulty.

In some embodiments, the difficulty of the gripping surface may depend on the size, shape, slope, surface area, gripping surface area, etc. of the gripping surface. For example, an easy level gripping surface may have the most generous foot and hand hold area and gripping surface (e.g., a generous float foot ledge and finger hold or vertical lip). As another example, a medium level gripping surface may provide a toe hold and two finger gripping areas (e.g., two hand holds with saddle for toe hold). As another example, a difficult level gripping surface may have the lowest profile finger grip nest (e.g., a sloping finger grip with ledge to the side for hand grip).

In some embodiments, the adjustable rock hold may comprise indicators configured to indicate the level of difficulty associated with each gripping surface. For example, a circle may indicate easy, a square may indicate medium, and/or a diamond may indicate difficult. In other embodiments, a variety of numbers, letters, words, shapes, icons, and/or a combination thereof may be used as indicators. In some embodiments, the indicators may be molded onto one or more surfaces of the adjustable rock hold.

In some embodiments, the adjustable rock hold may comprise an outer portion comprising the gripping surfaces and a center portion configured to lock the outer portion in place onto the climbing surface. In some embodiments, the center portion may interface with the outer portion via ridges and slots, for example, so as to lock the outer portion into a particular orientation with respect to the climbing surface. Additionally or alternatively, in some embodiments, the center portion may interface with the outer portion via a spring, lock, bearing, locking pin, and/or another interface mechanism.

In some embodiments, the center portion may comprise a circular shape, a square shape, a rectangular shape, an oval shape, an irregular shape, or some other shape configured to interface with the center portion. In other words, the outer portion may comprise an opening with a shape coordinating with the shape of the center portion.

In another embodiment, the outer portion may be configured to be flipped with respect to the center portion (e.g., removed, flipped from one face to another face, and remounted), instead of being configured to be rotated about the center portion. In other words, the adjustable rock hold may comprise two or more difficulty level gripping surfaces, which may be on same face of the adjustable rock hold (wherein the adjustable rock hold may be rotated), and/or may be on opposite faces of the adjustable rock hold (wherein the adjustable rock hold may be flipped).

In some embodiments, the adjustable rock hold may comprise three gripping surfaces, wherein the gripping surface area of the medium difficulty gripping surface may be between approximately 25% and 75% of the gripping surface area of the easy difficulty gripping surface, and wherein the gripping surface area of the hard difficulty gripping surface may be between approximately 25%-75% of the gripping surface area of the medium difficulty gripping surface.

In some embodiments, the adjustable rock hold may comprise three gripping surfaces, where an easy difficulty gripping surface may comprise a width (or length) of approximately 15-30 mm, a medium difficulty gripping surface may comprise a width (or length) of approximately 5-15 mm, and a hard difficulty gripping surface may comprise a width (or length) of approximately 1-5 mm.

FIG. 1 illustrates an adjustable rock hold 100 comprising at least two gripping surfaces 110, 120, and 130, wherein the at least two gripping surfaces 110, 120, and 130 comprise different difficulty levels. The difficulty level of the gripping surface may be determined by the size, shape, slope, and layout of the gripping surface 110, 120, and 130. The adjustable rock hold 100 may be configured to be locked into at least two configurations and/or positions, wherein one gripping surface may be positioned to be accessed by a user (or climber) in each configuration/position.

In some embodiments, the adjustable rock hold 100 may comprise an adjustable, rotatable outer portion 102, wherein the gripping surfaces 110, 120, and 130 may be incorporated into and/or molded into the outer portion 102. In some embodiments, the adjustable rock hold 100 may comprise an inner, fixed center portion 104 configured to fit within the outer portion 102, and optionally configured to lock the outer portion 102 into one of the plurality of configurations. In some embodiments, the center portion 104 may comprise a different color than the outer portion 102.

In some embodiments, the adjustable rock hold 100 may comprise one or more indicators 112, 122, and 132 (optionally on the surface of the outer portion 102) corresponding to each of the gripping surfaces 110, 120, and 130, configured to indicate difficulty of the gripping surface. In the embodiment shown in FIG. 1, the indicators 112, 122, and 132 may comprise various shapes, while in other embodiments, the indicators 112, 122, and 132 may comprise numbers, letters, words, shapes, icons, and/or any combination thereof.

In some embodiments, the adjustable rock hold 100 may comprise and indicator arrow 105 (optionally on the surface of the center portion 104) which may indicate installation direction. In some embodiments, when rotating the outer portion 102 between the different gripping surfaces 110, 120, and 130 and/or configurations, the arrow indicator 105 may be configured to align with the one or more indicators 112, 122, and 132 on the outer portion 102. In some embodiments, the center portion 104 may be attached to a surface using a mounting mechanism 106.

Figure 2:
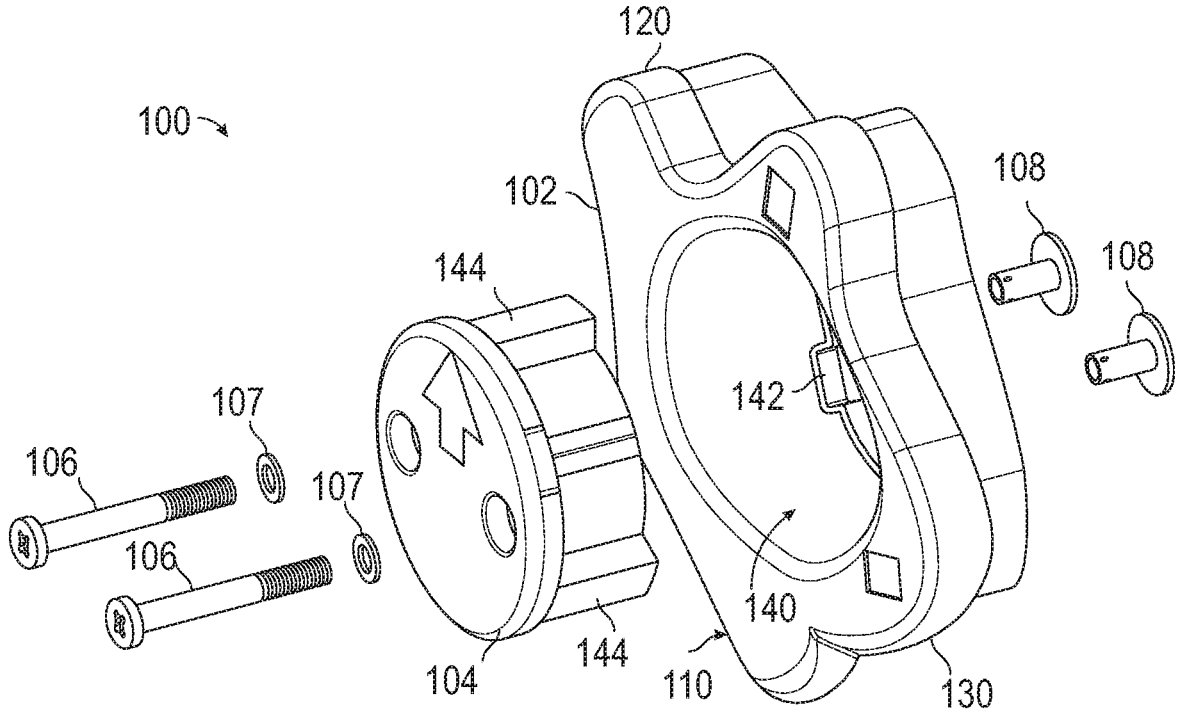
FIG. 2 illustrates an exploded view of an adjustable rock hold according to an embodiment of the disclosure.

FIG. 2 illustrates an exploded view of the adjustable rock hold 100 described in FIG. 1. In the embodiment shown, the mounting mechanism may comprise securing assemblages, such as one or more bolts 106, one or more washers 107, and one or more nuts 108.

As shown in FIG. 2, the center portion 104 may be configured to fit into an opening 140 in the outer portion 102, and the center portion 104 may comprise one or more ridges 144 configured to align with one or more slots 142 in the opening 140. In some embodiments, the outer portion 102 may be rotated with respect to the center portion 104, and the ridges 144 may disengage from the slots 142 and then reengage with the slots 142 in a different configuration, after the outer portion 102 is rotated. For example, to change the adjustable rock hold 100 from one configuration to another, the mounting mechanism 106 may be loosened, the center portion 104 may be pulled away from the outer portion 102, the outer portion 102 may be rotated, the center portion 104 may be pushed back into the outer portion 102, and the mounting mechanism 106 may be re-tightened.

Figure 3:
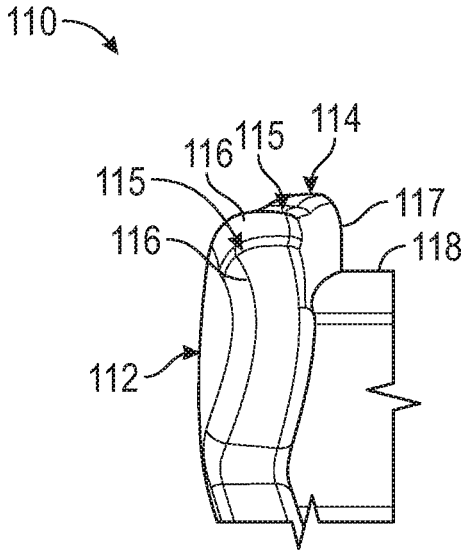
FIG. 3 illustrates a side view of a gripping surface of an adjustable rock hold according to an embodiment of the disclosure.

FIG. 3 illustrates a side view of a first gripping surface 110, as described above. The first gripping surface 110 may comprise a surface topography 114 that may include one or more of a vertical lip 117, a horizontal plane 118, one or more valleys 115, and/or one or more peaks 116. In some embodiments, the horizontal plane 118 may be flat, curved, dipped, convex, and/or concave. The vertical lip 117 may allow a user's hand to grip the surface. The valleys 115 and peaks 116 may be shaped to fit a user's hand and/or foot, and the size and shape of the valleys 115 and peaks 116 may vary based on the difficulty of the gripping surface 110.

In some embodiments, the topography 114 may comprise a plurality of shapes including one or more of a saddle, lip, arch, peak, slope, valleys (for fingers) which may all be narrow or wide depending on the difficulty. In some embodiments, the topography 114 may be shaped for top gripping and/or side gripping.

Figure 4:
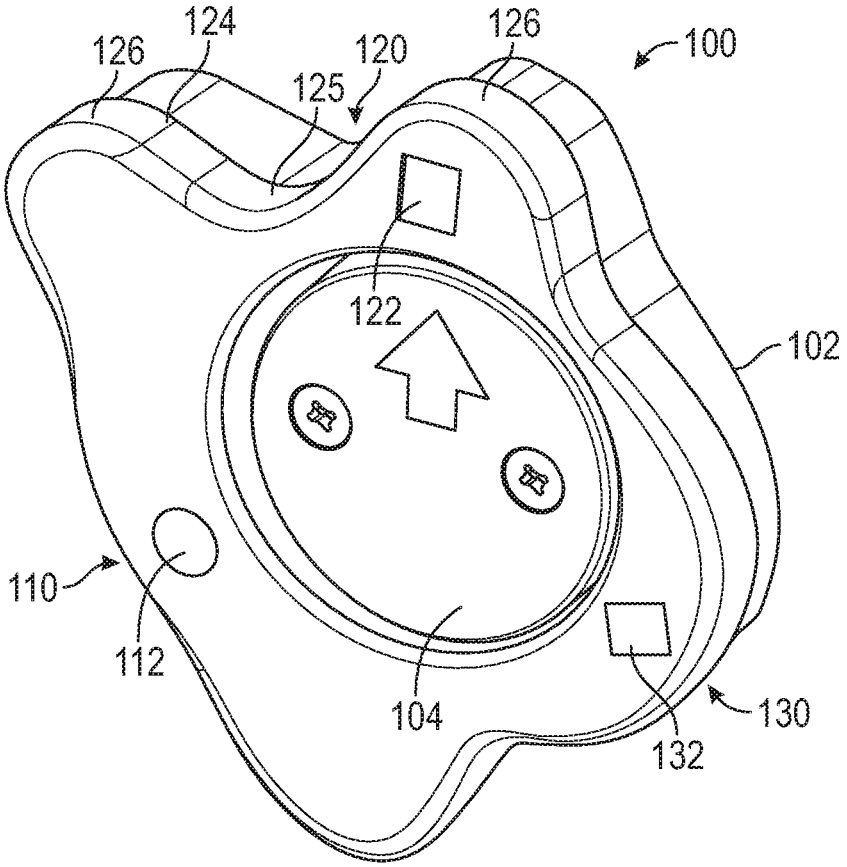
FIG. 4 illustrates a perspective view of an adjustable rock hold according to an embodiment of the disclosure.
Figure 5:
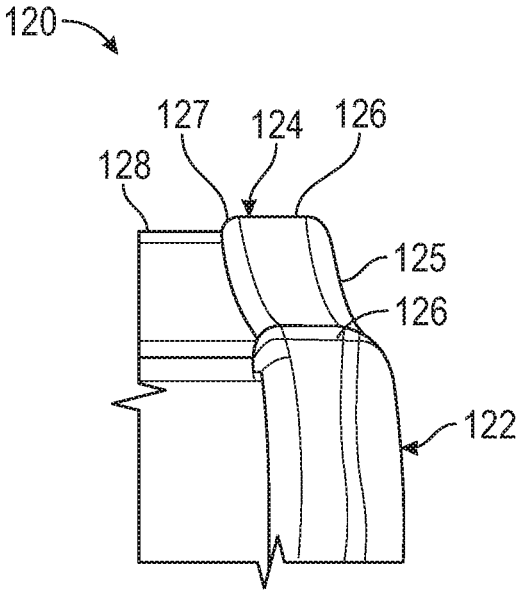
FIG. 5 illustrates a side view of a gripping surface of an adjustable rock hold according to an embodiment of the disclosure.

FIGS. 4 and 5 illustrate a perspective view and a side view of a second gripping surface 120. The second gripping surface 120 may comprise a surface topography 124 that may include one or more of a vertical lip 127, a horizontal plane 128, one or more valleys 125, and/or one or more peaks 126. In some embodiments, the horizontal plane 128 may be flat, curved, dipped, convex, and/or concave. The vertical lip 127 may allow a user's hand to grip the surface. The valleys 125 and peaks 126 may be shaped to fit a user's hand and/or foot, and the size and shape of the valleys 125 and peaks 126 may vary based on the difficulty of the gripping surface 120.

Figure 6:
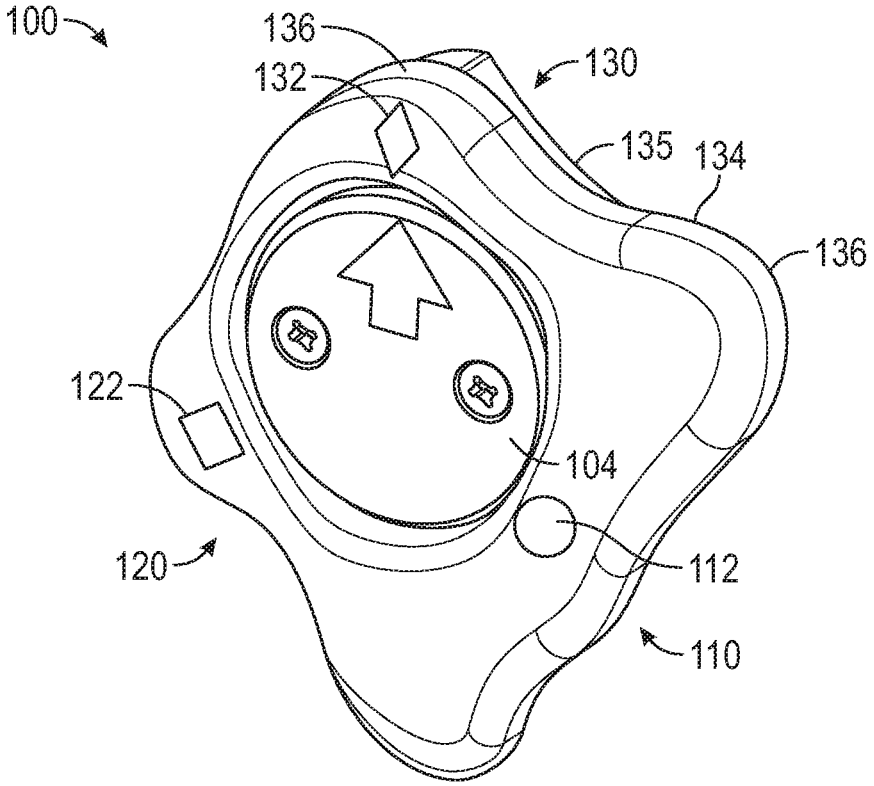
FIG. 6 illustrates a perspective view of an adjustable rock hold according to an embodiment of the disclosure.
Figure 7:
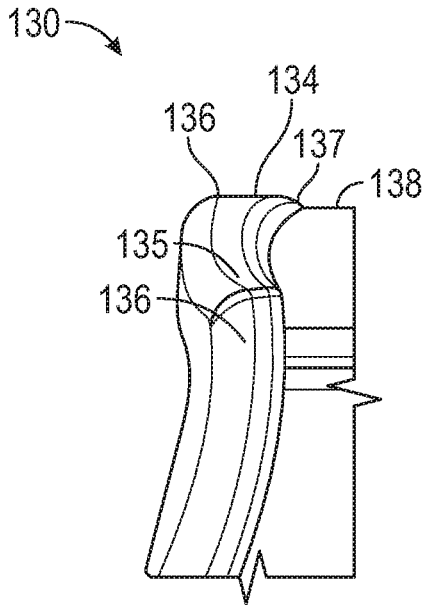
FIG. 7 illustrates a side view of a gripping surface of an adjustable rock hold according to an embodiment of the disclosure.

FIGS. 6 and 7 illustrate a perspective view and a side view of a third gripping surface 130. The third gripping surface 130 may comprise a surface topography 134 that may include one or more of a vertical lip 137, a horizontal plane 138, one or more valleys 135, and/or one or more peaks 136. In some embodiments, the horizontal plane 138 may be flat, curved, dipped, convex, and/or concave. The vertical lip 137 may allow a user's hand to grip the surface. The valleys 135 and peaks 136 may be shaped to fit a user's hand and/or foot, and the size and shape of the valleys 135 and peaks 136 may vary based on the difficulty of the gripping surface 130.

Figure 8:
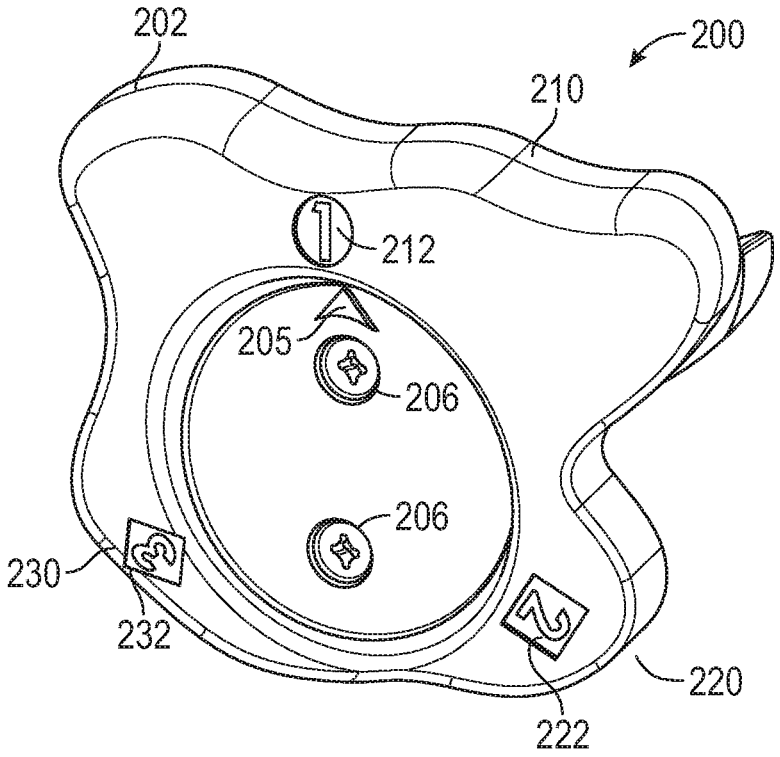
FIG. 8 illustrates a perspective view of an adjustable rock hold according to an embodiment of the disclosure.
Figure 9:
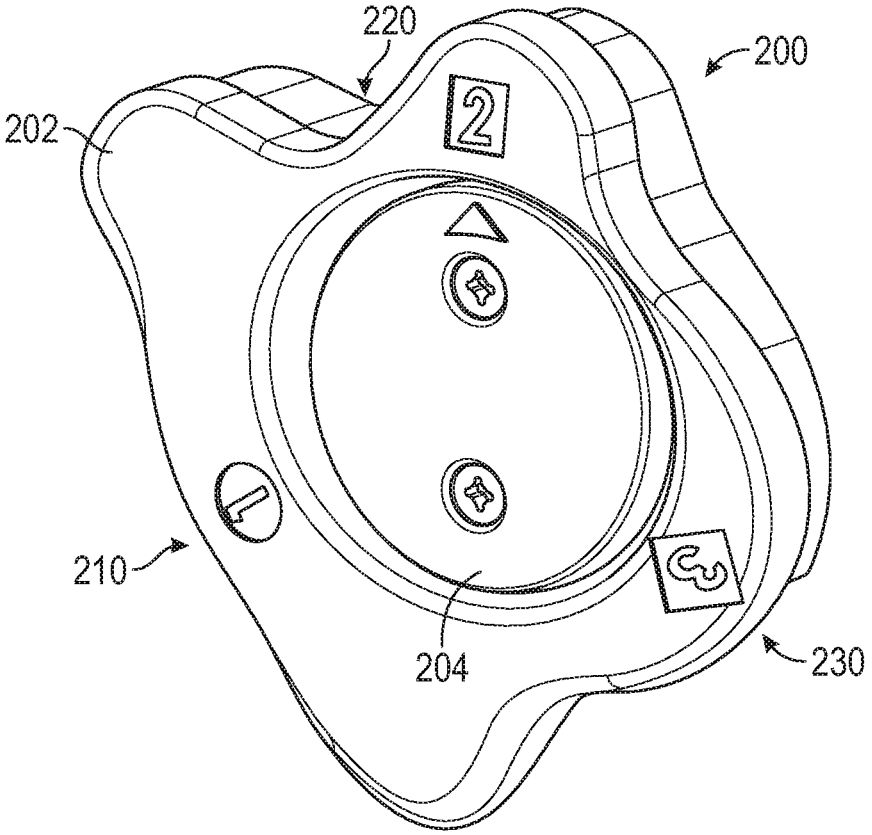
FIG. 9 illustrates a perspective view of an adjustable rock hold according to an embodiment of the disclosure.
Figure 10:
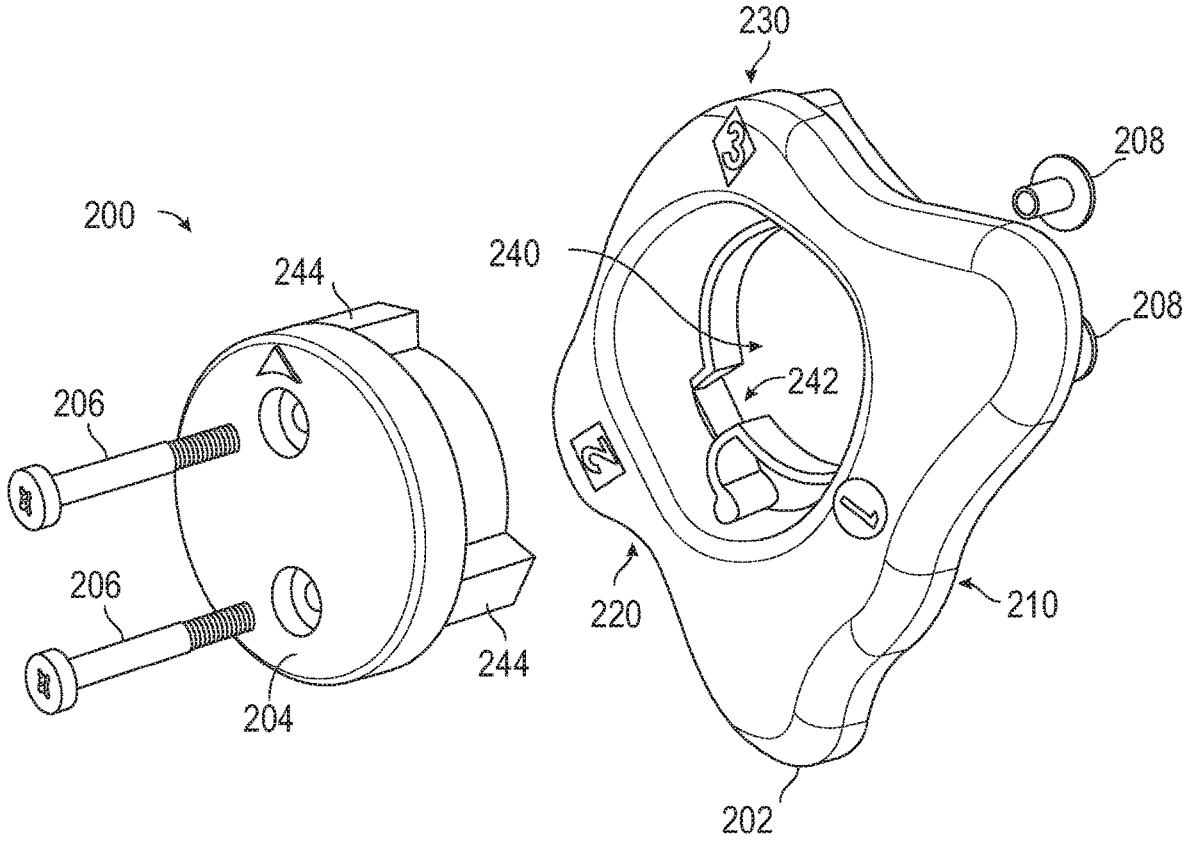
FIG. 10 illustrates an exploded view of an adjustable rock hold according to an embodiment of the disclosure.

FIGS. 8, 9 and 10 illustrate another adjustable rock hold 200 (which may be similar to adjustable rock hold 100 described above) comprising an outer portion 202, a center portion 204, and at least two gripping surfaces 210, 220, and 230. The outer portion 202 may comprise one or more indicators 212, 222, and 232 corresponding to the at least two gripping surfaces 210, 220, and 230. The center portion 204 may comprise and arrow indicator 205. The adjustable rock hold 200 may also comprise at least one mounting mechanism 206 (which may comprise a bolt 206 and nut 208, for example).

As shown in FIG. 10, the center portion 204 may be configured to fit into an opening 240 in the outer portion 202, and the center portion 204 may comprise one or more ridges 244 configured to align with one or more slots 242 in the opening 240. In some embodiments, the outer portion 202 may be rotated with respect to the center portion 104, and the ridges 244 may disengage from the slots 242 and then reengage with the slots 242 in a different configuration, after the outer portion 202 is rotated with respect to the center portion 204. For example, to change the adjustable rock hold 200 from one configuration to another, the mounting mechanism 206 may be loosened, the center portion 204 may be pulled away from the outer portion 202, the outer portion 202 may be rotated, the center portion 204 may be pushed back into the outer portion 202, and the mounting mechanism 206 may be re-tightened.

Figure 11:
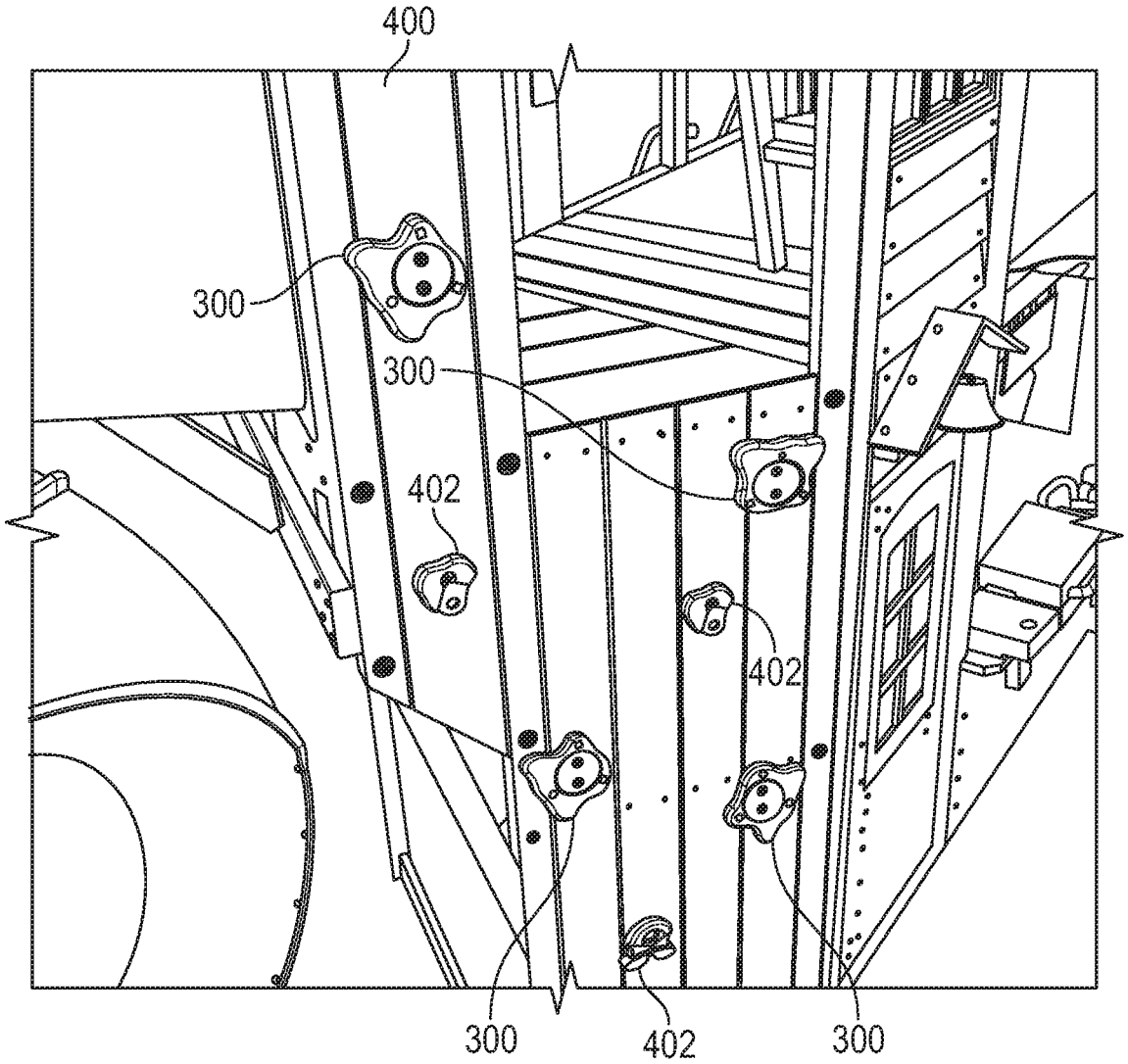
FIG. 11 illustrates an adjustable rock hold installed onto a climbing surface according to an embodiment of the disclosure.
Figure 12A:
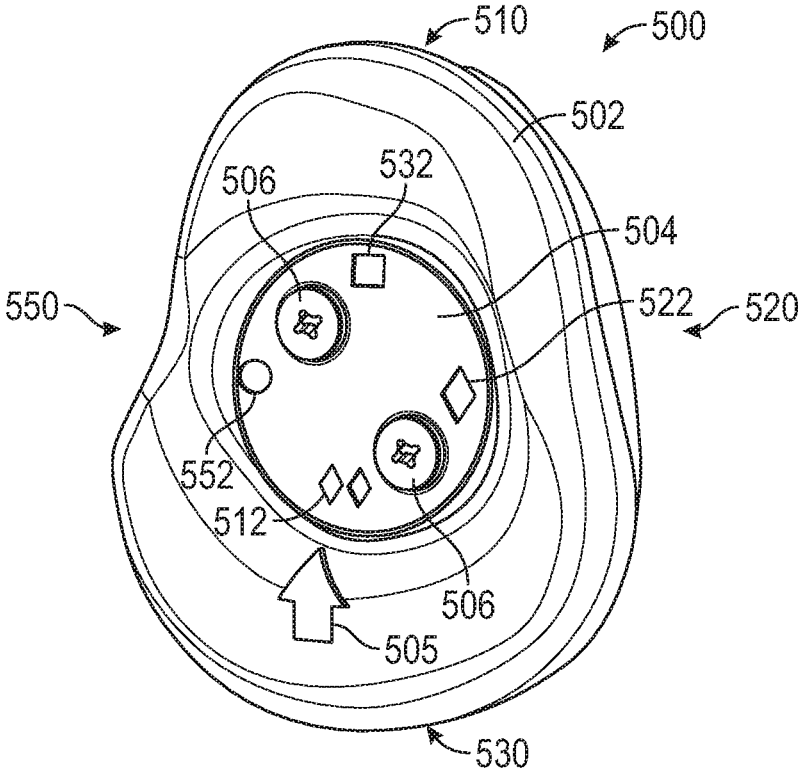
FIGS. 12A-12B illustrate detailed views of an adjustable rock hold according to an embodiment of the disclosure.
Figure 12B:
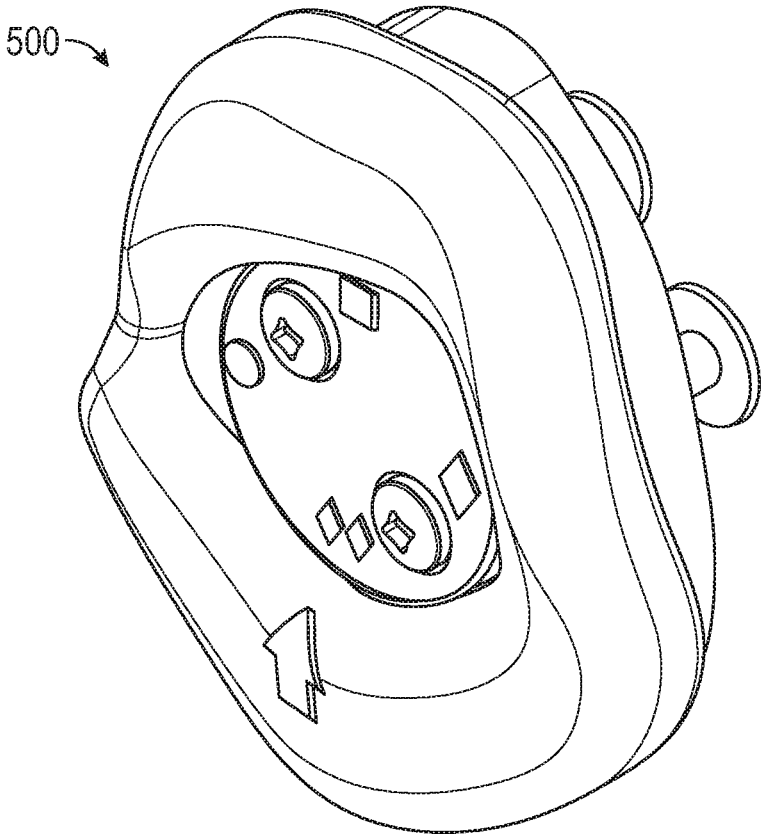
Figure 13A:
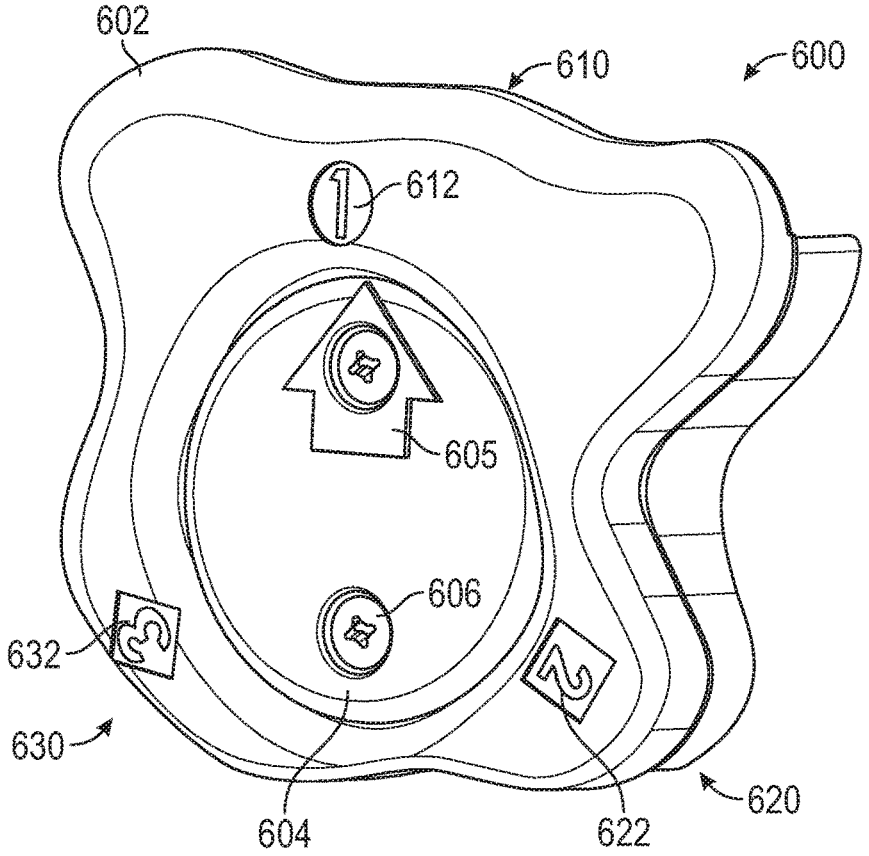
FIGS. 13A-13D illustrate detailed views of an adjustable rock hold according to an embodiment of the disclosure.
Figure 13B:
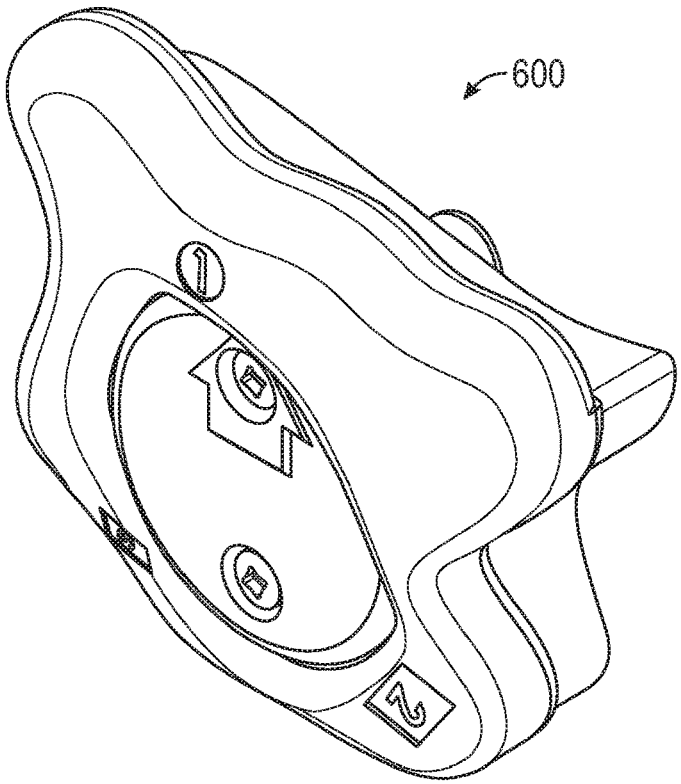
Figure 13C:
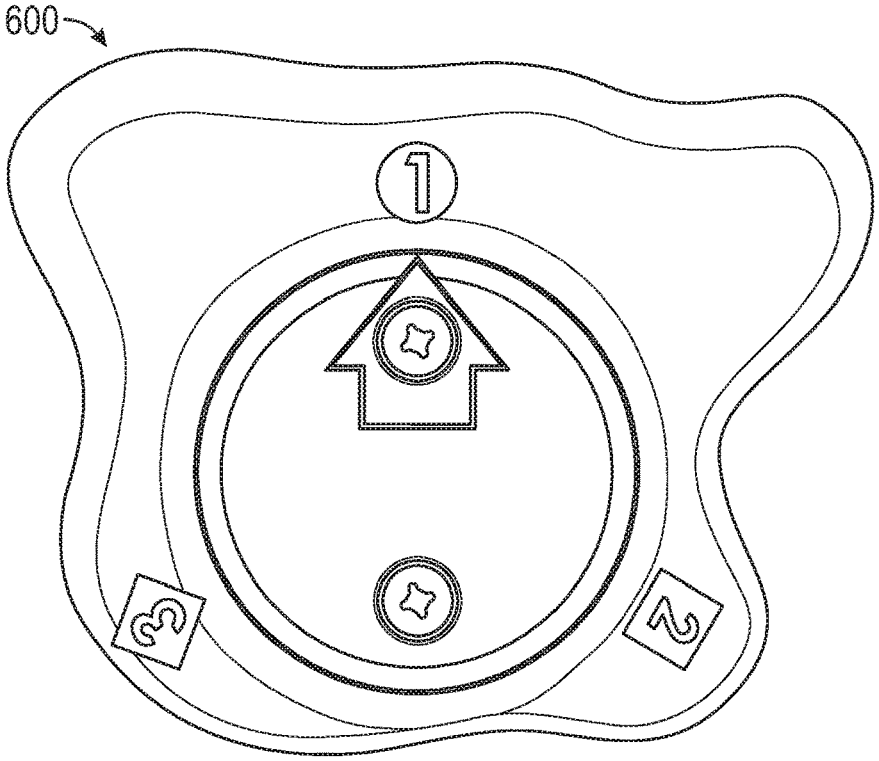
Figure 13D:
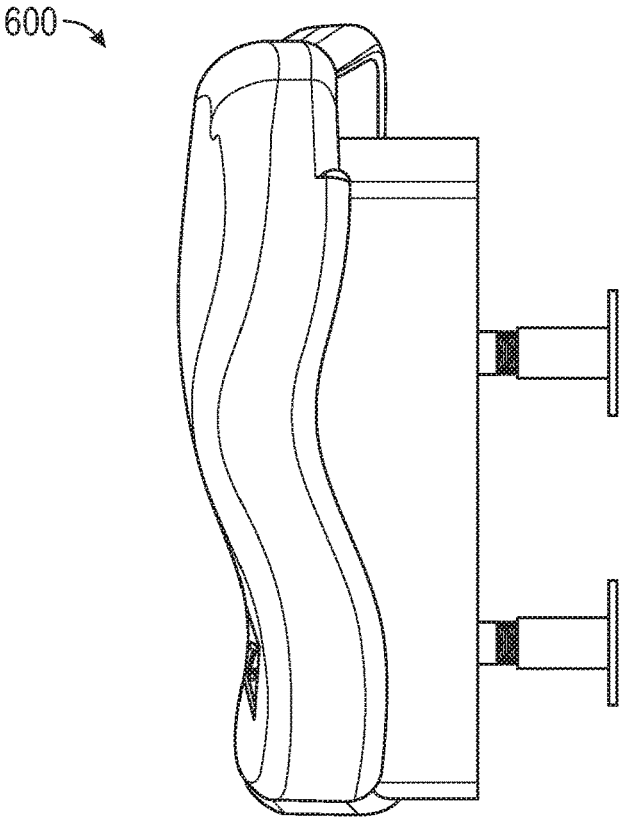
Figure 14A:
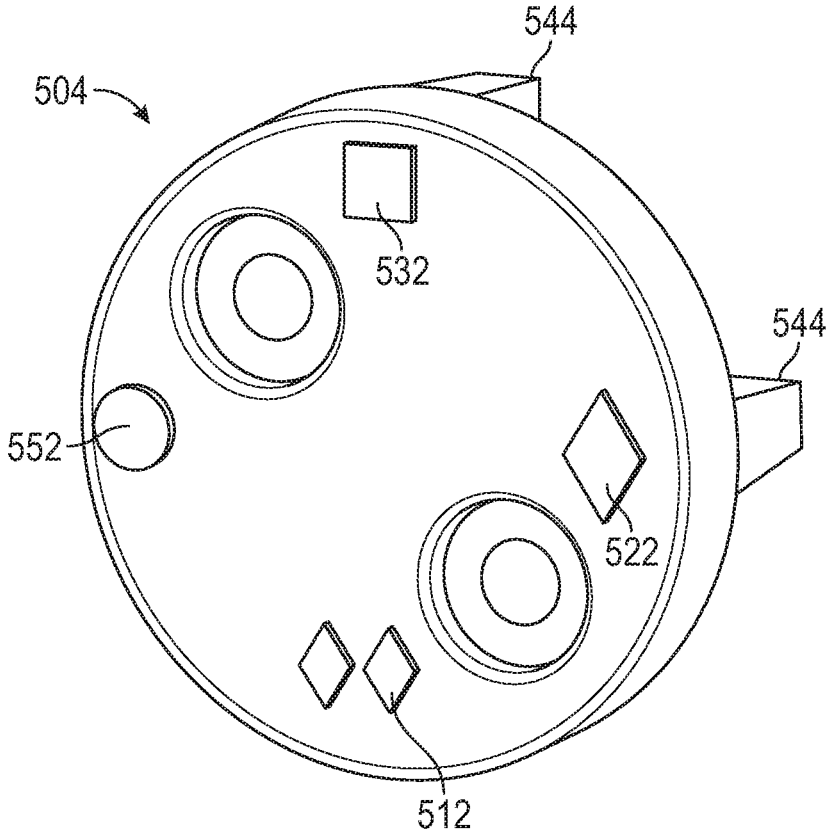
FIGS. 14A-14E illustrate detailed views of a center portion of an adjustable rock hold according to an embodiment of the disclosure.
Figure 14B:
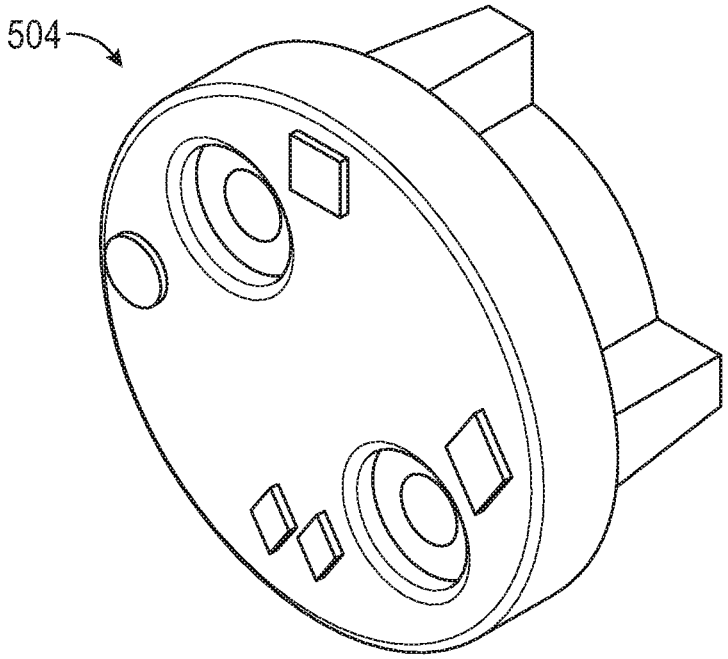
Figure 14C:
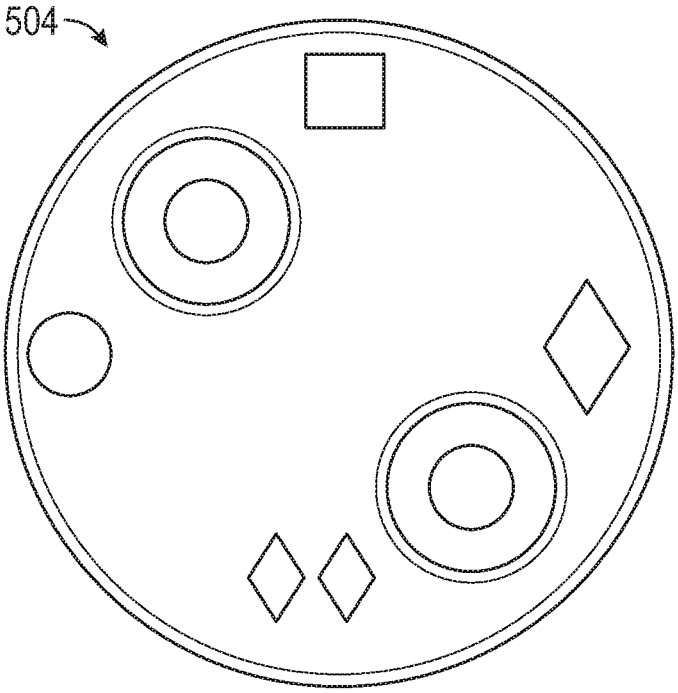
Figure 14D:
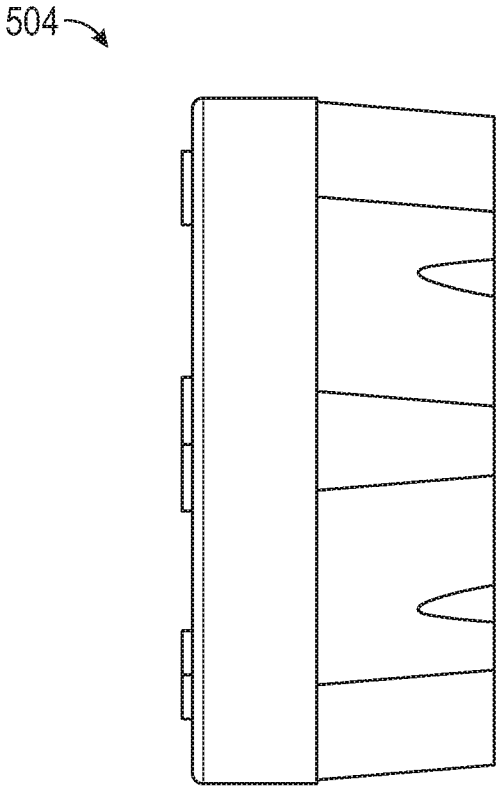
Figure 14E:
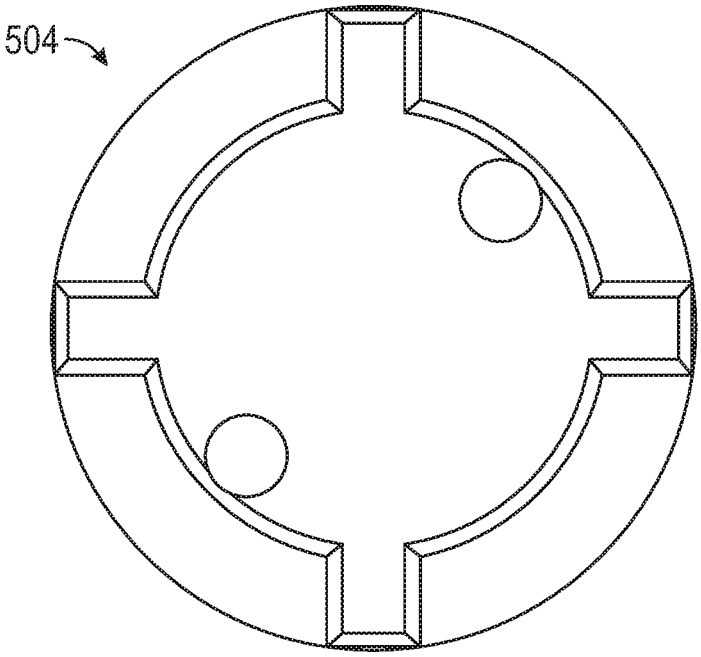
Figure 15A:
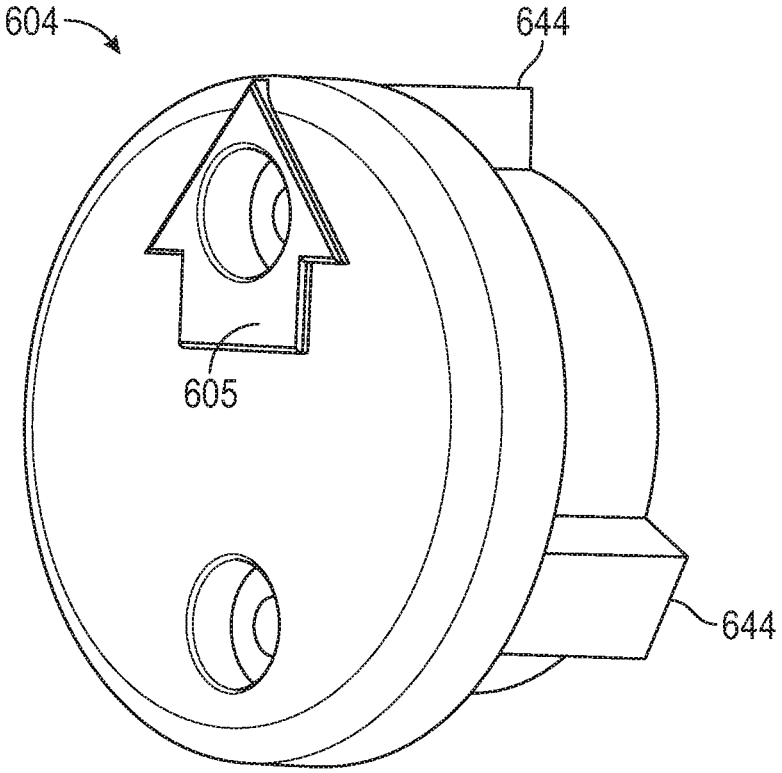
FIGS. 15A-15E illustrate detailed views of a center portion of an adjustable rock hold according to an embodiment of the disclosure.
Figure 15B:
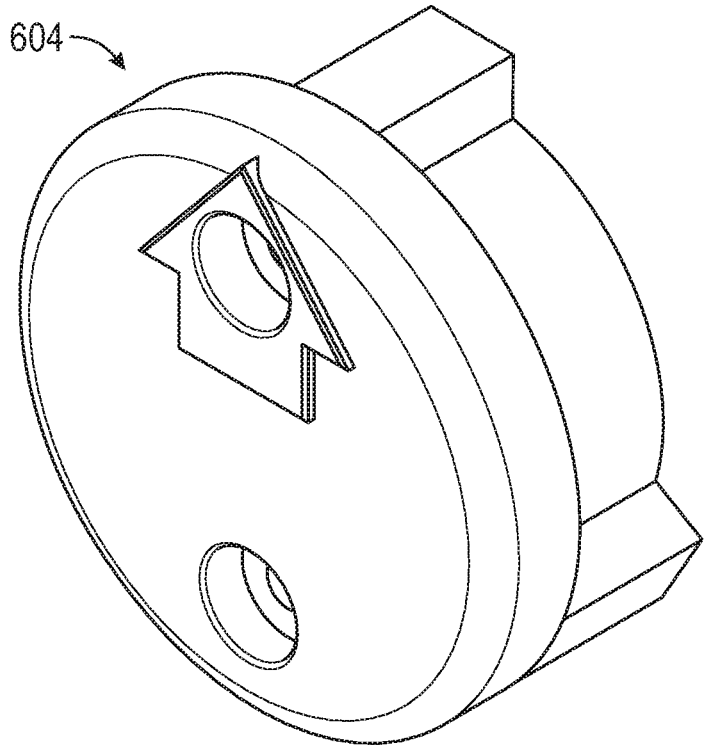
Figure 15C:
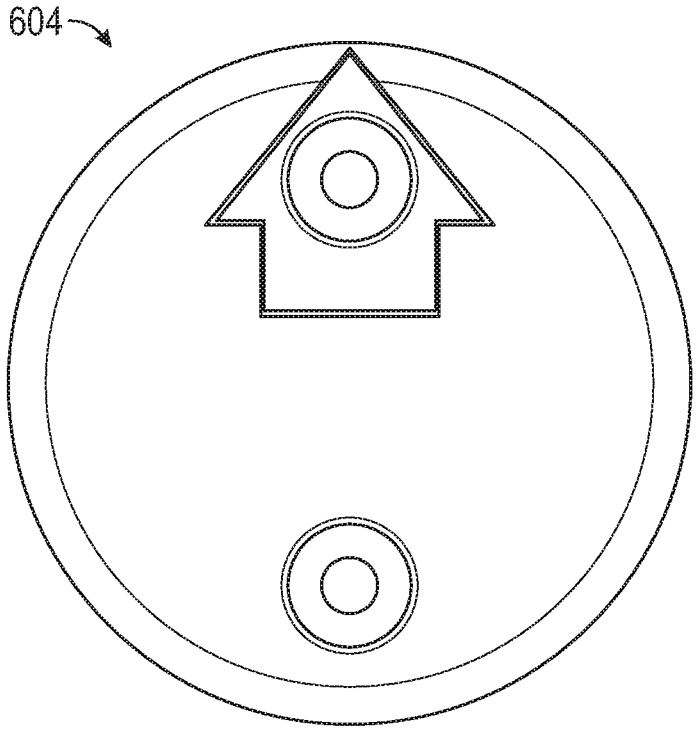
Figure 15D:
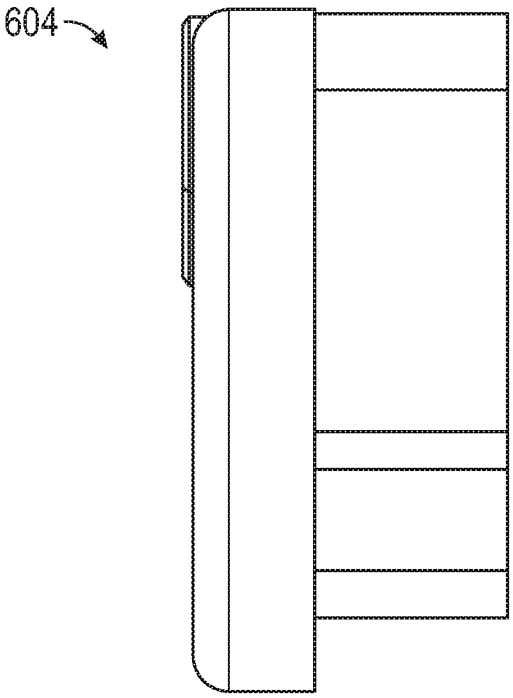
Figure 15E:
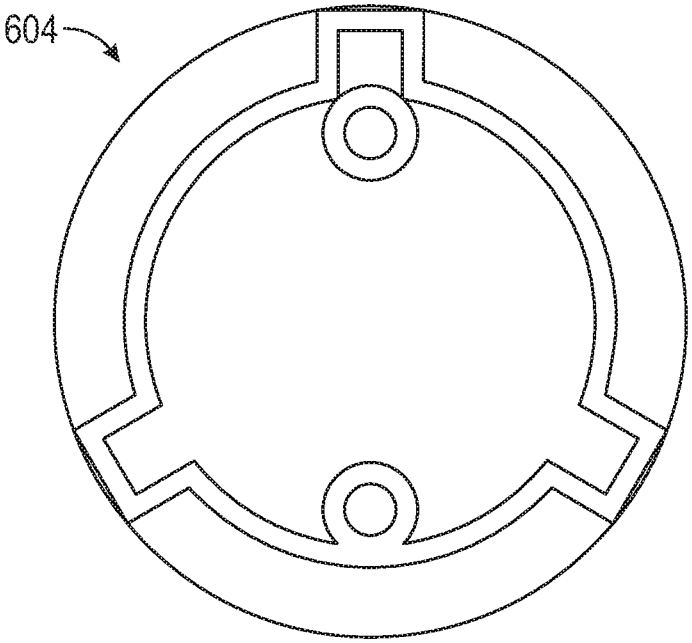

FIG. 11 illustrates a plurality of adjustable rock holds 300 (which may be similar to adjustable rock hold 100 and/or adjustable rock hold 100 described above) installed onto a play surface 400 (or climbing surface, or climbing wall). The adjustable rock holds 300 may be installed in different configurations where different gripping surfaces may be oriented to the top of the adjustable rock holds 300. In some embodiments, the adjustable rock holds 300 may be installed in addition to standard, fixed rock holds 402.

FIGS. 12A-12D illustrate an exemplary embodiment of an adjustable rock hold 500 comprising an outer portion 502, a center portion 504, and at least two gripping surfaces 510, 520, 530, and 550. The center portion 504 may comprise one or more indicators 512, 522, 532, and 552 corresponding to the at least two gripping surfaces 510, 520, 530, and 550. The outer portion 502 may comprise and arrow indicator 505. The adjustable rock hold 500 may also comprise at least one mounting mechanism 506.

FIGS. 13A-13D illustrate an exemplary embodiment of an adjustable rock hold 600 comprising an outer portion 602, a center portion 604, and at least two gripping surfaces 610, 620, and 630. The outer portion 602 may comprise one or more indicators 612, 622, and 632 corresponding to the at least two gripping surfaces 610, 620, and 630. The center portion 604 may comprise and arrow indicator 605. The adjustable rock hold 600 may also comprise at least one mounting mechanism 606.

FIGS. 14A-14E illustrate a detailed view of the center portion 504, which may comprise one or more ridges 544 (which may be similar to the ridges 144 described above). In some embodiments, the center portion 504 may comprise a circular shape, a square shape, a rectangular shape, an oval shape, an irregular shape, or some other shape configured to interface with the center portion, where the outer portion 502 (shown in FIGS. 12A-12D) may be shaped to interface with the center portion 504. In other words, the outer portion 502 may comprise an opening with a shape coordinating with the shape of the center portion 504.

FIGS. 15A-15E illustrate a detailed view of the center portion 604, which may comprise one or more ridges 644 (which may be similar to the ridges 144 described above). In some embodiments, the center portion 604 may comprise a circular shape, a square shape, a rectangular shape, an oval shape, an irregular shape, or some other shape configured to interface with the center portion, where the outer portion 602 (shown in FIGS. 13A-13D) may be shaped to interface with the center portion 604. In other words, the outer portion 602 may comprise an opening with a shape coordinating with the shape of the center portion 604.

Figure 16:
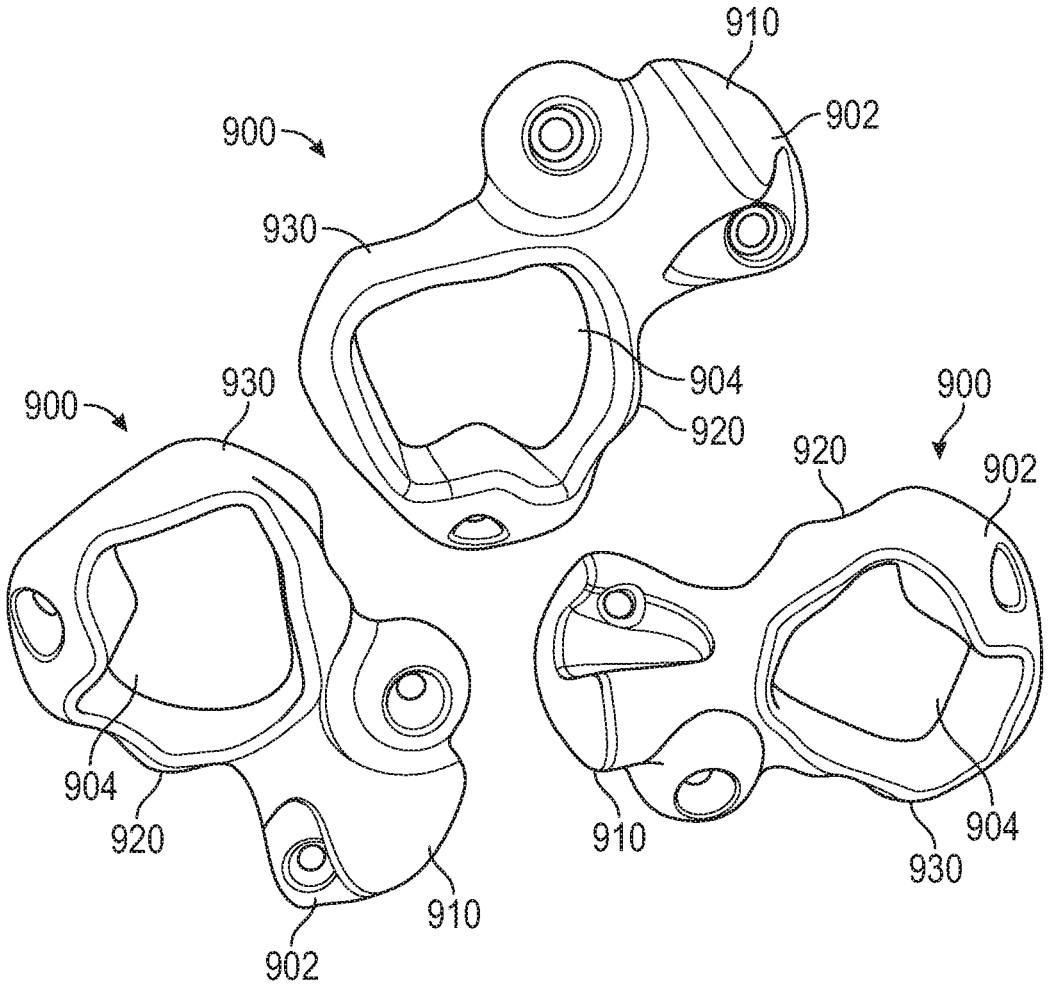
FIG. 16 illustrates another adjustable rock hold according to an embodiment of the disclosure.

FIG. 16 illustrates another embodiment of an adjustable rock hold 900 comprising a molded body 902 comprising an opening 904, and comprising two or more gripping surfaces 910, 920, and 930. The opening 904 may also function as a gripping surface. The opening 904 may comprise a large pocket hold with wood reveal, and the adjustable rock hold 900 may be oriented in various directions.

Figure 17:
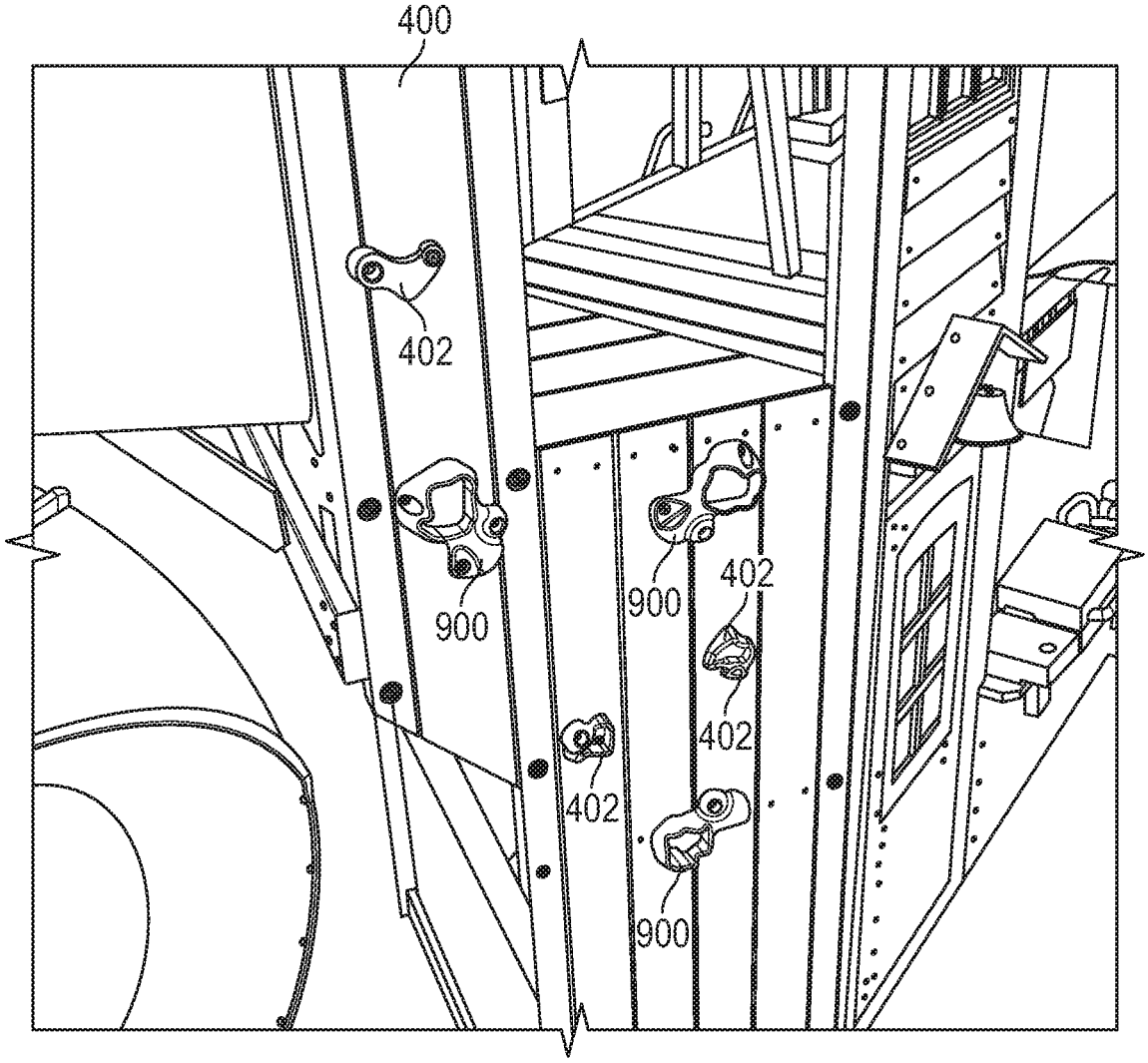
FIG. 17 illustrates an adjustable rock hold installed onto a climbing surface according to an embodiment of the disclosure.

FIG. 17 illustrates a plurality of adjustable rock holds 900 installed onto a play surface 400 (or climbing surface, or climbing wall). The adjustable rock holds 900 may be installed in different configurations where different gripping surfaces may be oriented to the top of the adjustable rock holds 900. In some embodiments, the adjustable rock holds 900 may be installed in addition to standard, fixed rock holds 402.

Figure 18:
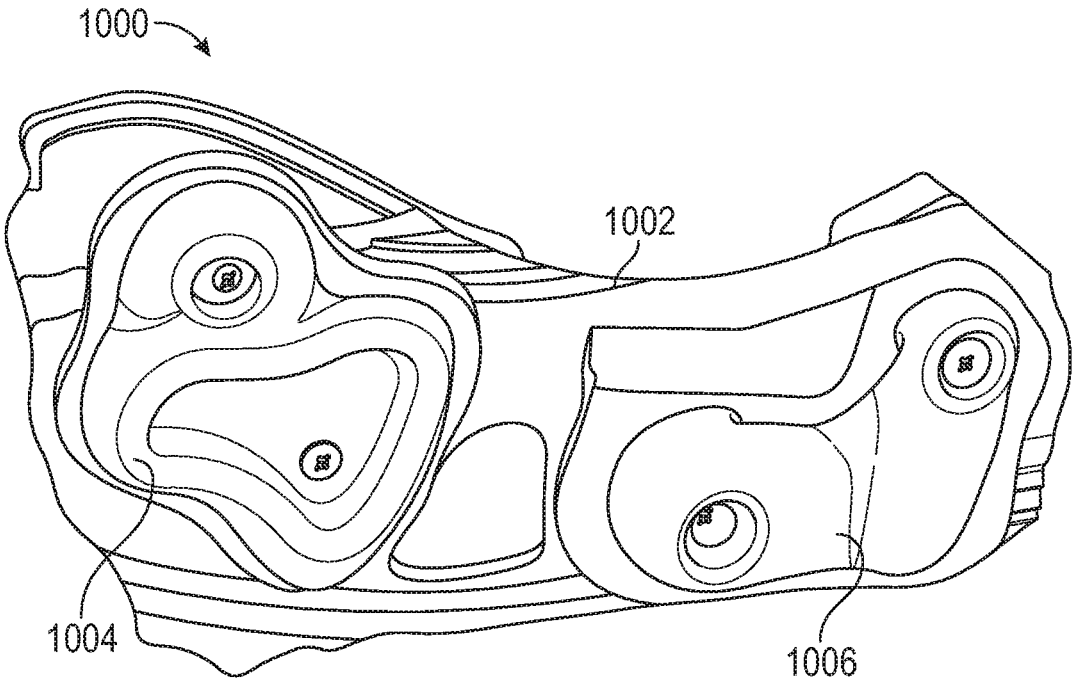
FIG. 18 illustrates another adjustable rock hold according to an embodiment of the disclosure.
Figure 19:
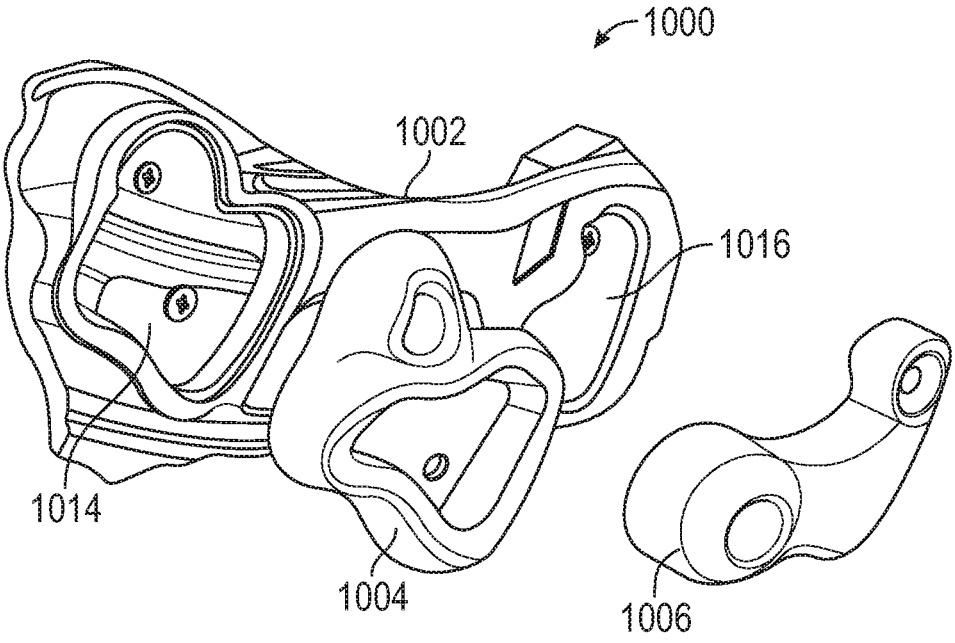
FIG. 19 illustrates an exploded view of an adjustable rock hold according to an embodiment of the disclosure.

FIGS. 18 and 19 illustrate another embodiment of an adjustable rock hold 1000 comprising a base 1002, and comprising two or more gripping surfaces smaller rock holds 1004 and 1006, wherein the smaller rock holds 1004 and 1006 may fit into recesses 1014 and 1016 of the base 1002. The base 1002 can be installed alone, and/or with one or more of the smaller rock holds 1004 and 1006. The base 1002 and/or the smaller rock holds 1004 and 1006 may comprise a variety of gripping surfaces, and the adjustable rock hold 1000 can be oriented in a variety of directions with various hold positions.

Figure 20:
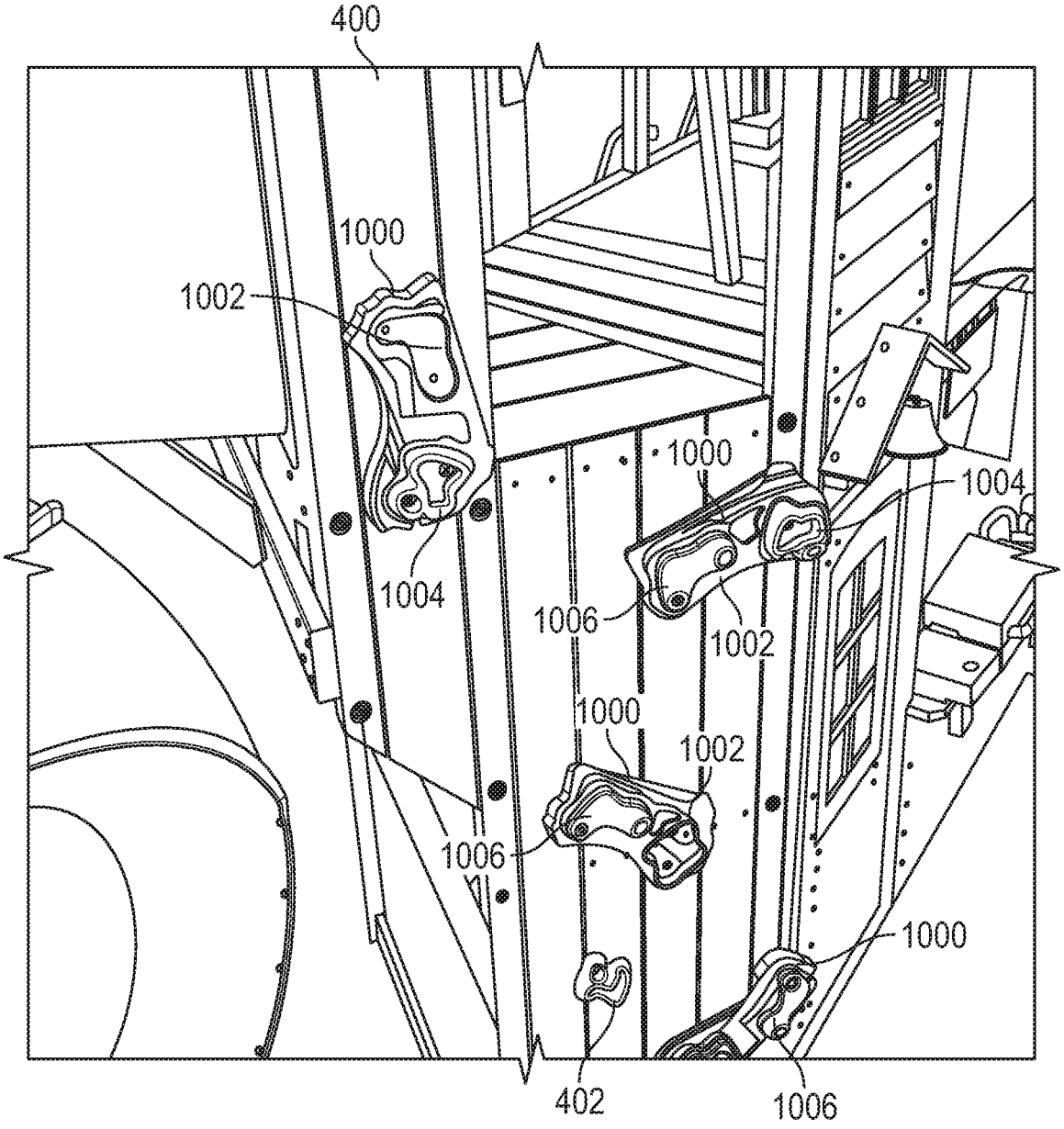
FIG. 20 illustrates an adjustable rock hold installed onto a climbing surface according to an embodiment of the disclosure.

FIG. 20 illustrates a plurality of adjustable rock holds 1000 installed onto a play surface 400 (or climbing surface, or climbing wall). The adjustable rock holds 1000 may be installed in different configurations (e.g., orientations) where different gripping surfaces may be oriented to the top of the adjustable rock holds 1000, and where the base 1002 may be used with one or both of the smaller rock holds 1004 and 1006. In some embodiments, the adjustable rock holds 1000 may be installed in addition to standard, fixed rock holds 402.

Figure 21:
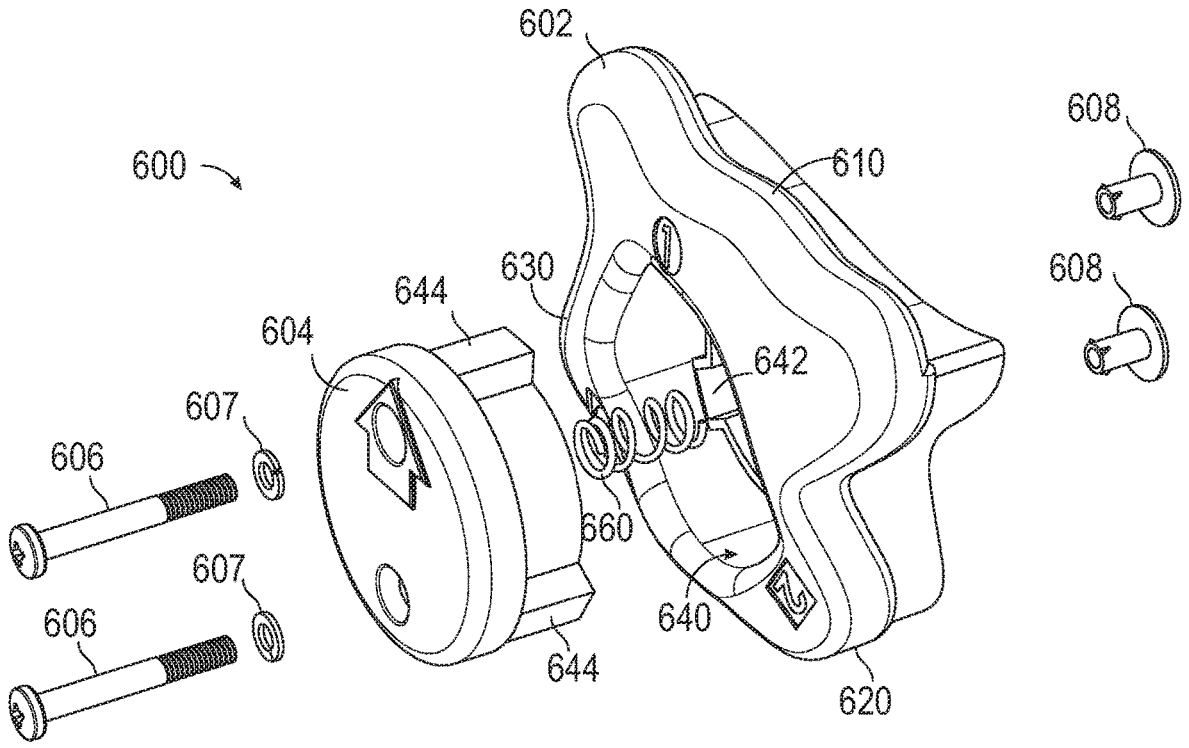
FIG. 21 illustrates an exploded view of an adjustable rock hold according to an embodiment of the disclosure.
Figure 22:
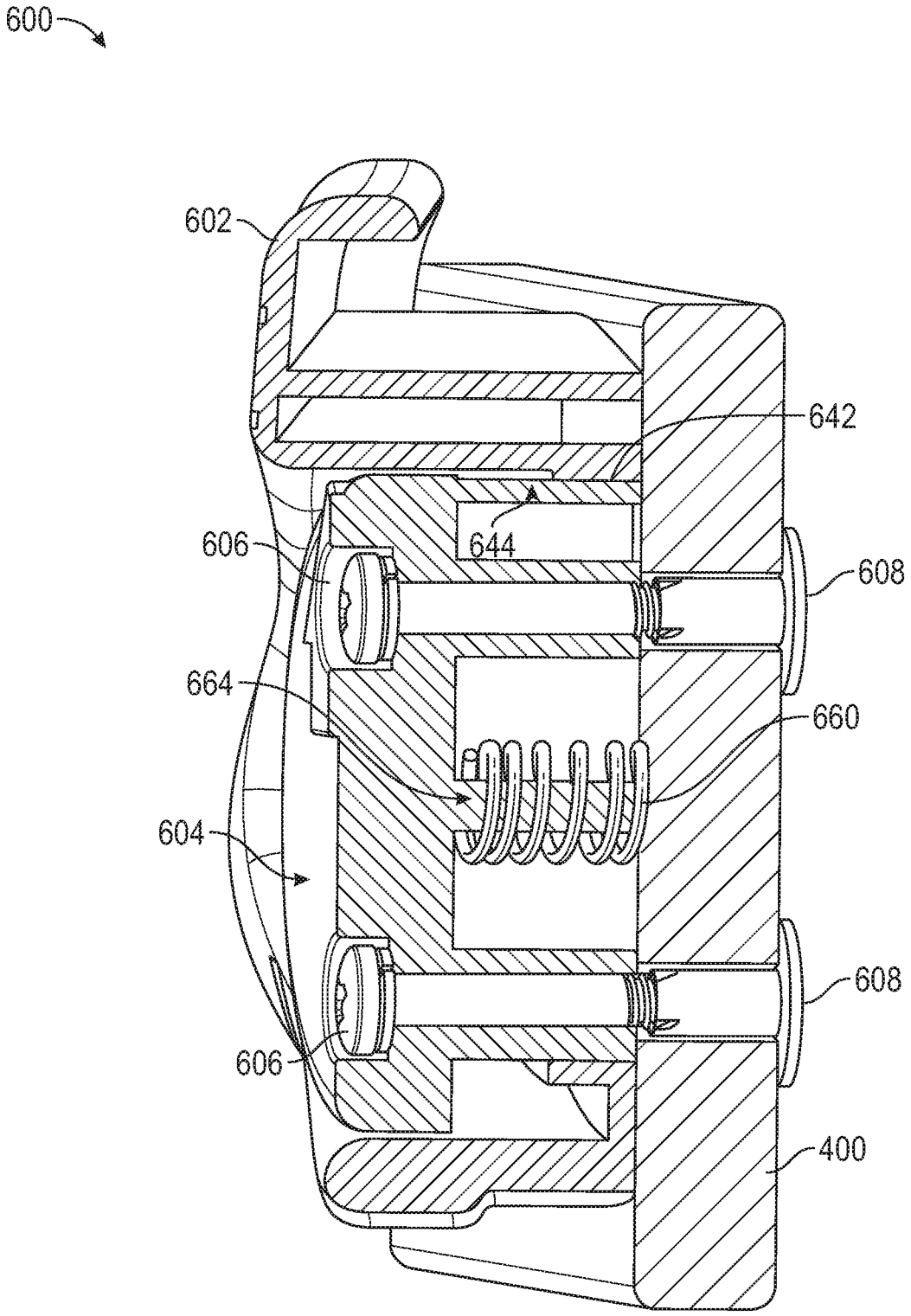
FIG. 22 illustrates a partial cross-sectional view of an adjustable rock hold according to an embodiment of the disclosure.
Figure 23:
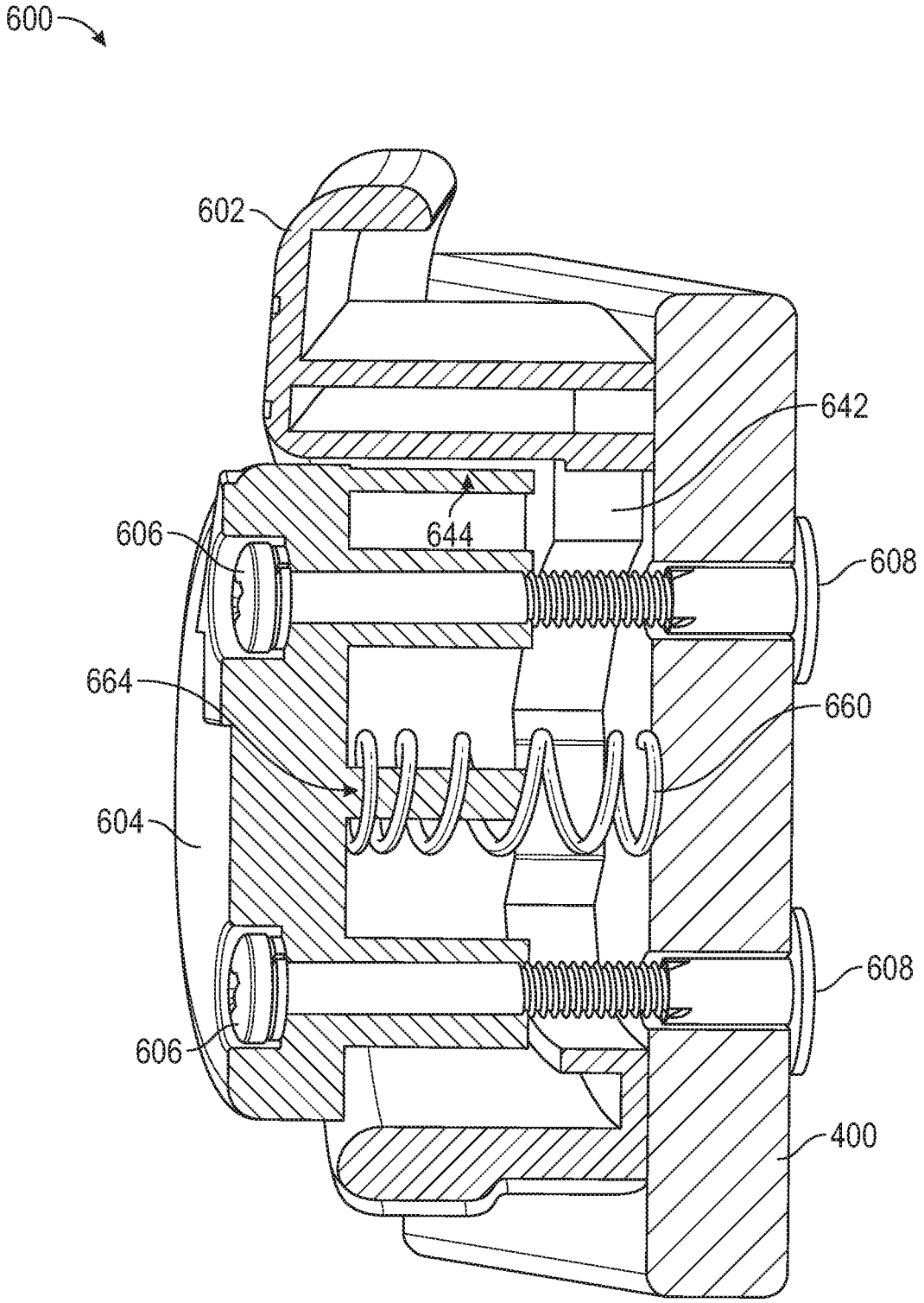
FIG. 23 illustrates another partial cross-sectional view of an adjustable rock hold according to an embodiment of the disclosure.

FIGS. 21, 22, and 23 illustrate another embodiment of an adjustable rock hold 600, wherein the adjustable rock hold 600 (first described in FIGS. 13A-13D) further comprises a bias element 660 (or spring) positioned between the center portion 604 and a play (or climbing) surface 400. As described above, the adjustable rock hold 600 may comprise an outer portion 602, a center portion 604, and at least two gripping surfaces 610, 620, and 630. The outer portion 602 may comprise one or more indicators 612, 622, and 632 corresponding to the at least two gripping surfaces 610, 620, and 630. The center portion 604 may comprise and arrow indicator 605. The adjustable rock hold 600 may also comprise at least one mounting mechanism 606. In some embodiments, the mounting mechanism 606 may comprise one or more bolts configured to interface with one or more nut 608 and/or washer 607.

As shown in FIG. 22, in some embodiments, the bolt(s) 606 may fit through openings in the center portion 604 and pass through a play (or climbing) surface 400, where the nut(s) 608 may attach to the bolt(s) 606 to secure the adjustable rock hold 600 to the play surface 400. Similar to embodiments described above, the center portion 604 may be configured to fit into an opening 640 in the outer portion 602, and the center portion 604 may comprise one or more ridges 644 configured to align with one or more slots 642 in the opening 640. In some embodiments, the outer portion 602 may be rotated with respect to the center portion 604, where the ridges 644 may disengage from the slots 642 and then reengage with the slots 642 in a different configuration, after the outer portion 602 is rotated. For example, to change the adjustable rock hold 600 from one configuration to another, the mounting mechanism 606 may be loosened, the center portion 604 may be pulled away (and/or biased away) from the outer portion 602, the outer portion 602 may be rotated, the center portion 604 may be pushed back into the outer portion 602 (possibly against the bias), and the mounting mechanism 606 may be re-tightened.

In the embodiment shown in FIGS. 22 and 23, when the mounting mechanism (or bolt) 606 is loosened (as in FIG. 23), the spring 660 may bias the center portion 604 away from the play surface 400, and therefore bias the ridges 644 to disengage from the slots 642. When the ridges 644 are disengaged from the slots 642, the outer portion 602 may be rotated with respect to the center portion 604, allowing a user to change the adjustable rock hold 600 to a different configuration (e.g., orientation). In some embodiments, re-tightening the mounting mechanism 606 may push the center portion 604 against the spring 660 to allow the ridges 644 to reengage with the slots 642 (as shown in FIG. 22).

In some embodiments, the spring 660 may contact the center portion 604, while in other embodiments, the spring 660 may be permanently and/or removably attached to the center portion 604. In some embodiments, the center portion 604 may comprise a projection 664 around which the spring 660 may fit.

Embodiments of the disclosure may comprise one or more method of use, mounting, adjusting, and/or rotating an adjustable rock hold. For example, to change an adjustable rock hold from one configuration to another, the mounting mechanism may be loosened, the center portion may be pulled away from the outer portion, the outer portion may be rotated, the center portion may be pushed back into the outer portion, and the mounting mechanism may be re-tightened.

As another example, to change an adjustable rock hold from one configuration to another, the mounting mechanism may be loosened, the center portion may be pulled away from the outer portion, the outer portion may be flipped, the center portion may be pushed back into the outer portion, and the mounting mechanism may be re-tightened.

As another example, to change an adjustable rock hold from one configuration to another, the outer portion may be disengaged from the center portion, the outer portion may be flipped so as the portion that previously contacted the play surface now faces away from the play surface and the portion that prior to flipping faced away from the play surface will contact the play surface upon reengaging the outer portion with the center portion.

As another example, to change an adjustable rock hold from one configuration to another, the outer portion may be disengaged from the center portion, the outer portion may be rotated, and the outer portion may be reengaged to the center portion.

As another example, to change an adjustable rock hold from one configuration to another, the center portion may be pulled away from the outer portion against a spring force, the outer portion may be rotated, and the center portion may be biased back into the outer portion by the spring. Optionally, a locking pin may be removed from the adjustable rock hold before the center portion is pulled away from the outer portion, and the locking pin may be reinserted into the adjustable rock hold after the center portion is biased back into the outer portion.

Having described various devices and methods herein, exemplary embodiments or aspects can include, but are not limited to:

Embodiment No. 1 is an adjustable rock hold comprising a rotatable outer portion configured to rotate about an axis of the adjustable rock hold and rotate with respect to a climbing surface, wherein the adjustable rock hold is configured to be attached to the climbing surface, a plurality of gripping surfaces positioned around an outer edge of the rotatable outer portion, and one or more securing elements configured to secure the rotatable outer portion with respect to the climbing surface.

Embodiment No. 2 is the adjustable rock hold of Embodiment No. 1, wherein the gripping surfaces comprise different levels of difficulty.

Embodiment No. 3 is the adjustable rock hold of one of Embodiment Nos. 1-2, wherein the one or more securing elements comprise one or more bolts configured to fit through openings in the rotatable outer portion and secure the rotatable outer portion onto the climbing surface.

Embodiment No. 4 is the adjustable rock hold of one of Embodiment Nos. 1-3, wherein the one or more securing elements comprises a fixed center portion of the adjustable rock hold configured to attach to the climbing surface and configured to interface with the rotatable outer portion to secure the rotatable outer portion onto the climbing surface.

Embodiment No. 5 is the adjustable rock hold of Embodiment No. 4, wherein the center portion is configured to fit into an opening in the outer portion, wherein the center portion comprises one or more ridges configured to align with one or more slots in the opening of the outer portion.

Embodiment No. 6 is the adjustable rock hold of one of Embodiment Nos. 4-5, wherein the one or more securing elements comprise one or more bolts configured to fit through openings in the center portion and secure the center portion in contact with the outer portion.

Embodiment No. 7 is the adjustable rock hold of one of Embodiment Nos. 4-6, further comprising a bias element positioned between the center portion and the climbing surface, wherein the bias element is configured to bias the center portion away from engagement with the rotatable outer portion when the center portion is loosened from attachment to the climbing surface, allowing the rotatable outer portion to be rotated with respect to the center portion.

Embodiment No. 8 is the adjustable rock hold of one of Embodiment Nos. 1-7, further comprising a first configuration wherein a first gripping surface is positioned at the top of the rotatable outer portion, and a second configuration wherein a second gripping surface is positioned at the top of the rotatable outer portion.

Embodiment No. 9 is the adjustable rock hold of Embodiment No. 8, wherein the adjustable rock hold is configured to be rotated between the first configuration and the second configuration without completely removing the adjustable rock hold from attachment with the climbing surface.

Embodiment No. 10 is a method of using an adjustable rock hold comprising securing at least a portion of the adjustable rock hold to a play surface, wherein the adjustable rock hold is positioned in a first configuration, loosening the attachment between the play surface and the adjustable rock hold, rotating a rotatable outer portion of the adjustable rock hold with respect to the play surface from the first configuration to a second configuration, tightening the attachment between the play surface and the adjustable rock hold to maintain the rotatable outer portion in the second configuration;

Embodiment No. 11 is the method of Embodiment No. 10, wherein securing at least a portion of the adjustable rock hold to the play surface comprises attaching the rotatable outer portion to the play surface using one or more bolts configured to fit through openings in the rotatable outer portion.

Embodiment No. 12 is the method of one of Embodiment Nos. 10-11, wherein securing at least a portion of the adjustable rock hold to the play surface comprises securing a center portion to the play surface, wherein the center portion engages with the rotatable outer portion to hold the position of the rotatable outer portion.

Embodiment No. 13 is the method of Embodiment No. 12, further comprising, after loosening the attachment between the play surface and the adjustable rock hold, biasing the center portion away from engagement with the rotatable outer portion, allowing the rotatable outer portion to be rotated with respect to the center portion.

Embodiment No. 14 is the method of Embodiment No. 13, wherein biasing the center portion is accomplished by a spring positioned between the center portion and the play surface.

Embodiment No. 15 is the method of one of Embodiment Nos. 10-14, wherein the first configuration comprises positioning a first gripping surface at the top of the rotatable outer portion, and wherein the second configuration comprises positioning a second gripping surface at the top of the rotatable outer portion.

Embodiment No. 16 is a play structure comprising a play surface and one or more adjustable rock holds configured to be adjustably attached to the play surface, the one or more adjustable rock holds comprising a rotatable outer portion configured to rotate about an axis of the adjustable rock hold and rotate with respect to the play surface, a plurality of gripping surfaces positioned around an outer edge of the rotatable outer portion, and one or more securing elements configured to secure the rotatable outer portion with respect to the play surface.

Embodiment No. 17 is the play structure of Embodiment No. 16, wherein the one or more securing elements comprise one or more bolts configured to fit through openings in the rotatable outer portion and secure the rotatable outer portion onto the play surface.

Embodiment No. 18 is the play structure of one of Embodiment Nos. 16-17, wherein the one or more securing elements comprises a fixed center portion of the adjustable rock hold configured to attach to the play surface and configured to interface with the rotatable outer portion to secure the rotatable outer portion onto the play surface.

Embodiment No. 19 is the play structure of Embodiment No. 18, wherein the center portion is configured to fit into an opening in the outer portion, wherein the center portion comprises one or more ridges configured to align with one or more slots in the opening of the outer portion.

Embodiment No. 20 is the play structure of one of Embodiment Nos. 18-19, further comprising a bias element positioned between the center portion and the play surface, wherein the bias element is configured to bias the center portion away from engagement with the rotatable outer portion when the center portion is loosened from attachment to the play surface, allowing the rotatable outer portion to be rotated with respect to the center portion.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An adjustable rock hold comprising:

a rotatable outer portion configured to rotate about an axis of the adjustable rock hold and rotate with respect to a climbing surface, wherein the adjustable rock hold is configured to be attached to the climbing surface;

a plurality of gripping surfaces positioned around an outer edge of the rotatable outer portion;

one or more securing elements configured to secure the rotatable outer portion with respect to the climbing surface, wherein the one or more securing elements comprises a fixed center portion of the adjustable rock hold configured to attach to the climbing surface and configured to interface with the rotatable outer portion to secure the rotatable outer portion onto the climbing surface; and a bias element positioned between the fixed center portion and the climbing surface, wherein the bias element is configured to bias the fixed center portion away from engagement with the rotatable outer portion when the fixed center portion is loosened from attachment to the climbing surface, allowing the rotatable outer portion to be rotated with respect to the fixed center portion.

2. The adjustable rock hold of claim 1, wherein the gripping surfaces comprise different levels of difficulty.

3. The adjustable rock hold of claim 1, wherein the one or more securing elements comprise one or more bolts configured to fit through openings in the rotatable outer portion and secure the rotatable outer portion onto the climbing surface.

4. The adjustable rock hold of claim 1, wherein the center portion is configured to fit into an opening in the outer portion, wherein the center portion comprises one or more ridges configured to align with one or more slots in the opening of the outer portion.

5. The adjustable rock hold of claim 1, wherein the one or more securing elements comprise one or more bolts configured to fit through openings in the center portion and secure the center portion in contact with the outer portion.

6. The adjustable rock hold of claim 1, further comprising a first configuration wherein a first gripping surface is positioned at the top of the rotatable outer portion, and a second configuration wherein a second gripping surface is positioned at the top of the rotatable outer portion.

7. The adjustable rock hold of claim 6, wherein the adjustable rock hold is configured to be rotated between the first configuration and the second configuration without completely removing the adjustable rock hold from attachment with the climbing surface.

8. A method of using an adjustable rock hold comprising:

securing at least a portion of the adjustable rock hold to a play surface to form an attachment between the play surface and the adjustable rock hold, wherein the adjustable rock hold is positioned in a first configuration, wherein securing at least a portion of the adjustable rock hold to the play surface comprises securing a center portion to the play surface, wherein the center portion engages with the rotatable outer portion to hold the position of the rotatable outer portion;

loosening the attachment between the play surface and the adjustable rock hold;

biasing the center portion away from engagement with the rotatable outer portion, allowing the rotatable outer portion to be rotated with respect to the center portion;

rotating a rotatable outer portion of the adjustable rock hold with respect to the play surface from the first configuration to a second configuration; and tightening the attachment between the play surface and the adjustable rock hold to maintain the rotatable outer portion in the second configuration.

9. The method of claim 8, wherein securing at least a portion of the adjustable rock hold to the play surface comprises attaching the rotatable outer portion to the play surface using one or more bolts configured to fit through openings in the rotatable outer portion.

10. The method of claim 8, wherein biasing the center portion is accomplished by a spring positioned between the center portion and the play surface.

11. The method of claim 8, wherein the first configuration comprises positioning a first gripping surface at the top of the rotatable outer portion, and wherein the second configuration comprises positioning a second gripping surface at the top of the rotatable outer portion.

12. A play structure comprising:

a play surface; and one or more adjustable rock holds configured to be adjustably attached to the play surface, the one or more adjustable rock holds comprising:

a rotatable outer portion configured to rotate about an axis of the adjustable rock hold and rotate with respect to the play surface;

a plurality of gripping surfaces positioned around an outer edge of the rotatable outer portion;

one or more securing elements configured to secure the rotatable outer portion with respect to the play surface, wherein the one or more securing elements comprises a fixed center portion of the adjustable rock hold configured to attach to the play surface and configured to interface with the rotatable outer portion to secure the rotatable outer portion onto the play surface; and a bias element positioned between the fixed center portion and the play surface, wherein the bias element is configured to bias the fixed center portion away from engagement with the rotatable outer portion when the fixed center portion is loosened from attachment to the play surface, allowing the rotatable outer portion to be rotated with respect to the fixed center portion.

13. The play structure of claim 12, wherein the one or more securing elements comprise one or more bolts configured to fit through openings in the rotatable outer portion and secure the rotatable outer portion onto the play surface.

14. The play structure of claim 12, wherein the center portion is configured to fit into an opening in the outer portion, wherein the center portion comprises one or more ridges configured to align with one or more slots in the opening of the outer portion.

15. The play structure of claim 12, further comprising a bias element positioned between the center portion and the play surface, wherein the bias element is configured to bias the center portion away from engagement with the rotatable outer portion when the center portion is loosened from attachment to the play surface, allowing the rotatable outer portion to be rotated with respect to the center portion.

* * * * *